US007499667B2

(12) United States Patent
Matsuda

(10) Patent No.: US 7,499,667 B2
(45) Date of Patent: Mar. 3, 2009

(54) ENDLESS BELT DRIVE CONTROLLING APPARATUS INCLUDING ANGULAR DISPLACEMENT ERROR CALCULATION AND ASSOCIATED IMAGE FORMING APPARATUS

(75) Inventor: Yuji Matsuda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 335 days.

(21) Appl. No.: 11/420,929

(22) Filed: May 30, 2006

(65) Prior Publication Data

US 2006/0285887 A1 Dec. 21, 2006

(30) Foreign Application Priority Data

Jun. 21, 2005 (JP) ..... 2005-180412

(51) Int. Cl.
*G03G 15/01* (2006.01)

(52) U.S. Cl. ..... 399/302; 399/303

(58) Field of Classification Search ..... 399/167, 399/298, 299, 301–303
See application file for complete search history.

(56) References Cited

U.S. PATENT DOCUMENTS 6,324,355 B1 * 11/2001 Matsui et al. ..... 399/303
6,949,896 B2 9/2005 Andoh et al.
7,110,700 B2 * 9/2006 Andoh et al. ..... 399/167
7,251,444 B2 * 7/2007 Matsuda et al. ..... 399/301
7,376,375 B2 * 5/2008 Kobayashi et al. ..... 399/301
7,386,262 B2 * 6/2008 Okamura et al. ..... 399/298
2005/0053388 A1 3/2005 Yokoyama et al.
2005/0057209 A1 3/2005 Andoh et al.
2005/0085945 A1 4/2005 Andoh et al.
2005/0238372 A1 10/2005 Shinohara et al.

FOREIGN PATENT DOCUMENTS

JP 11-126004 5/1999
JP 2003-310897 11/2000
JP 2001-343878 12/2001

* cited by examiner

*Primary Examiner*—William J Royer
(74) *Attorney, Agent, or Firm*—Oblon, Spivak, McClelland, Maier & Neustadt, P.C.

(57) ABSTRACT

An endless belt drive controlling apparatus includes an endless belt and its drive unit, a first detector that detects a belt mark, a second detector that detects a detected angular displacement error of an encoder generated due to a variation in a thickness of the endless belt, a first calculating unit that calculates a phase and a maximum amplitude of the endless belt at the belt mark based on the detected angular displacement error of the encoder thus obtained, and a second calculating unit that calculates a position of the endless belt at which the detected angular displacement error is a minimum from the phase stored in a nonvolatile memory. The drive unit controls the endless belt so that the portion thereof at which the detected angular displacement error is the minimum is stopped at one of the rollers at which a highest tension is applied to the endless belt when the driver issues a belt stop command.

6 Claims, 15 Drawing Sheets

| COEFFICIENT | VALUE |
|---|---|
| a11= | 8173 |
| a21= | -2225 |
| b01= | 133 |
| b11= | 266 |
| b21= | 133 |
| a12= | 10389 |
| a22= | -5050 |
| b02= | 11022 |
| b12= | 22045 |
| b22= | 11022 |

| | |
|---|---|
| ISF | 2240 |
| qformat | 13 |

ENDLESS BELT DRIVE CONTROLLING APPARATUS INCLUDING ANGULAR DISPLACEMENT ERROR CALCULATION AND ASSOCIATED IMAGE FORMING APPARATUS

CROSS-REFERENCE TO RELATED APPLICATIONS

The present document incorporates by reference the entire contents of Japanese priority document, 2005-180412 filed in Japan on Jun. 21, 2005.

BACKGROUND OF THE INVENTION

1. Field of the Invention

The present invention relates to an image forming apparatus that forms a color image and an endless belt drive controlling apparatus used in this image forming apparatus.

2. Description of the Related Art

Typical image forming methods for a color image forming apparatus are roughly classified to a direct transfer type and an intermediate transfer type. According to the direct transfer image forming method, toner images different in color and formed on a plurality of photoconductors, respectively are directly transferred onto a transfer sheet while registering the images on one another. According to the intermediate transfer image forming method, toner images different in color and formed on a plurality of photoconductors, respectively are transferred onto an intermediate transfer body while registering the images on one another. Thereafter, the images are collectively transferred onto a transfer sheet. Since such an image forming apparatus has the photoconductors arranged to face the transfer sheet or the intermediate transfer body, the apparatus is referred to as a "tandem image forming apparatus". In the tandem image forming apparatus, an electrophotographic process including formation and development of an electrostatic latent image is executed for each color of yellow (Y), magenta (M), cyan (C), and black (K) per photoconductor. The images are transferred onto the transfer sheet that is being moved on a transfer and transport belt in the direct transfer type image forming apparatus. The images are transferred onto the intermediate transfer body that is being moved in the intermediate transfer type image forming apparatus.

For the tandem color image forming apparatus, it is important to highly accurately register the toner images in respective colors so as to prevent occurrence of out of color registration. For this reason, each of the direct transfer type apparatus and the intermediate transfer type apparatus is configured to attach an encoder to one of a plurality of driven rollers in a transfer unit. In addition, the apparatus of each type adopts a method for feedback controlling a rotational velocity of each driven roller according to a change in a rotational velocity of the encoder so as to avoid the out of color registration due to a change in a velocity of the transfer and transport belt.

The most common method for realizing a feedback control is a proportional control (PI control). The PI control is a method for controlling the belt so that an encoder output is always driven at the desired angular displacement. Specifically, in the PI control, a position error e(n) is computed from a difference between a desired angular displacement Ref(n) of the encoder and a detected angular displacement P(n−1) of the encoder. The position error e(n) thus computed is subjected to low pass filtering to eliminate high frequency noise, and multiplied by a control gain. A driving pulse frequency of a drive motor connected to a drive roller is controlled at a constant standard driving pulse frequency.

However, this PI method has the following disadvantages. If a thickness of the transfer and transport belt is changed slightly, a transport velocity of transporting the transfer sheet is changed. As a result, an image quality degradation that an image is deviated from a desired position and a fluctuation among images on a plurality of recording sheets, and a deterioration in a repeatability and a position reproducibility among the recording sheets occur.

Generally, a belt velocity, a radius of the driven roller, and a rotation angular displacement of the driven roller have a relationship as represented by the following equation.

$$\overline{\omega}=V/r$$

In the equation, $\overline{\omega}$ denotes the rotation angular displacement, V denotes the belt velocity, and r denotes the radius of the driven roller.

In this relationship, it is known experientially that the radius r of the driven roller includes the thickness of the belt.

FIG. 18 is an enlarged view of a contact portion in which a roller 66 to which an encoder is attached (hereinafter, "encoder roller 66") contacts with a transfer and transport belt 60. In FIG. 18, even if the transfer and transport belt 60 is moved at a constant velocity, an effective radius r of the encoder roller 66 is increased as long as a thick portion of the transfer and transport belt 60 is wound on the encoder roller 66. In addition, a rotation angular displacement of the encoder roller 66 per constant time is reduced. This reduction is detected as a reduction in a moving velocity of the transfer and transport belt 60. On the other hand, if a thin portion of the transfer and transport belt 60 is wound on the encoder roller 66, then the rotation angular displacement of the encoder roller 66 is increased, and the increase is detected as an increase in the moving velocity of the transfer and transport belt 60.

Due to this, even if the transfer and transport belt 60 is moved at a constant moving velocity, it is detected as if the moving velocity of the transfer and transport belt 60 is changed due to a change in belt thickness according to the rotation angular displacement detection by the encoder. In a driven shaft feedback control, this changed component is controlled to be amplified. This conversely adversely influences the belt moving velocity. As can be seen, the conventional feedback control method has a disadvantage in that a satisfactory feedback control in light of the change in belt thickness is not exercised.

As a method for solving a disadvantage of a feedback control failure resulting from the change in belt thickness, the following techniques are known as disclosed in, for example, Japanese Patent Application Laid-open (JP-A) Nos. 2000-310897, 2001-343878, and H11-126004. According to JP-A 2000-310897, if a drive roller is driven at a constant pulse rate, then a velocity profile is measured in advance so as to cancel a potential velocity change Vh that is generated due to a known thickness profile in all peripheral directions of the transfer and transport belt with reference to a position detected by a belt mark. A drive motor control signal is generated at a modulated pulse rate relative to the measured velocity profile. Based on this drive motor control signal, a motor is driven and the transfer and transport belt is driven through a drive motor. A final velocity Vb of the transfer and transport belt can be thereby made invariable.

JP-A No. 2001-343878 discloses an image forming apparatus that can start forming an image even before detection of a home position of a transfer and transport belt or an intermediate transfer belt, and that can reduce a time since the apparatus is activated until a first image is output. The image forming apparatus includes a movable belt member, an image forming unit that forms an image on the belt member or a recording material carried by the belt member, a detector, and a storage unit. The detector detects a reference position of the belt member. The storage unit stores information representing a movement amount by which the belt member is moved after the detector detects the reference position of the belt member when the belt member is stopped.

JP-A No. H11-126004 discloses an image forming apparatus that can detect an average velocity change throughout a belt without nipping the belt. The image forming apparatus includes a plurality of belt transport rollers including a belt drive roller and a velocity detection roller, a belt supported by the rollers, and a belt velocity controller. The velocity detection roller is arranged to be apart from the belt drive roller by a distance equal to or larger than a quarter of a perimeter of the belt. The belt velocity controller includes a roller rotational velocity detection sensor, a roller drive motor, a motor drive circuit, and a motor drive signal output unit. The roller rotational velocity detection sensor detects a rotational velocity of the velocity detection roller. The roller drive motor drives the belt drive roller to be rotated. The motor drive circuit drives the roller drive motor. The motor drive signal output unit outputs a motor drive circuit control signal according to a detection signal of the roller rotational velocity detection sensor.

However, these conventional techniques have the following disadvantage. The feedback control in light of the change in the belt moving velocity generated due to the thickness change of the endless belt cannot be exercised stably and favorably according to an image quality. In addition, the thickness of the endless belt spread over the rollers is changed, depending on a position at which the belt is left stopped, a belt leaving time, or the like. However, a technique for feedback controlling the endless belt in light of the thickness change of the belt is not developed yet.

SUMMARY OF THE INVENTION

The present invention has been proposed to cope with the aforementioned problems, and it is an object of the present invention to at least partially solve the problems in the conventional technology.

According to one aspect of the present invention, an endless belt drive controlling apparatus includes: an endless belt; a drive roller that drives the endless belt; a drive unit that drives the drive roller; a plurality of driven rollers driven to follow up the movement of the endless belt, wherein an encoder is attached to one of the driven rollers, a desired control value is set so that an angular displacement of the encoder per unit time is constant, and the drive unit is controlled to attain the desired control value; the endless belt drive controlling apparatus further includes: a belt mark indicating a reference position of the endless belt; a first detector that detects the belt mark; a second detector that detects a detected angular displacement error of the encoder generated due to a variation in a thickness of the endless belt; a first calculating unit that calculates a phase and a maximum amplitude of the endless belt at the belt mark based on the detected angular displacement error of the encoder obtained by the second detector; a nonvolatile memory that stores a calculation result of the first calculating unit; and a second calculating unit that calculates a position of the endless belt at which the detected angular displacement error of the encoder is a minimum from the phase stored in the nonvolatile memory, wherein the drive unit controls the endless belt so that the portion of the endless belt at which the detected angular displacement error of the encoder is the minimum is stopped at a position of one of the rollers at which a highest tension is applied to the endless belt when the drive unit issues a belt stop command.

According to another aspect of the present invention, an image forming apparatus that uses an endless belt drive controlling apparatus therein, the endless belt drive controlling apparatus includes: an endless belt that transfers and transports a recording member; a drive roller that drives the endless belt; a drive unit that drives the drive roller; a plurality of driven rollers driven to follow up the movement of the endless belt, wherein an encoder is attached to one of the driven rollers, a desired control value is set so that an angular displacement of the encoder per unit time is constant, and the drive unit is controlled to attain the desired control value, thereby to control the speed of the endless belt; the endless belt drive controlling apparatus further including: a belt mark indicating a reference position of the endless belt; a first detector that detects the belt mark; a second detector that detects a detected angular displacement error of the encoder generated due to a variation in a thickness of the endless belt; a first calculating unit that calculates a phase and a maximum amplitude of the endless belt at the belt mark based on the detected angular displacement error of the encoder obtained by the second detector; a nonvolatile memory that stores a calculation result of the first calculating unit; and a second calculating unit that calculates a position of the endless belt at which the detected angular displacement error of the encoder is a minimum from the phase stored in the nonvolatile memory, wherein the image forming apparatus makes the drive unit of the endless belt drive controlling apparatus control the endless belt so that the portion of the endless belt at which the detected angular displacement error of the encoder is the minimum is stopped at a position of one of the rollers at which a highest tension is applied to the endless belt when the drive unit issues a belt stop command.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
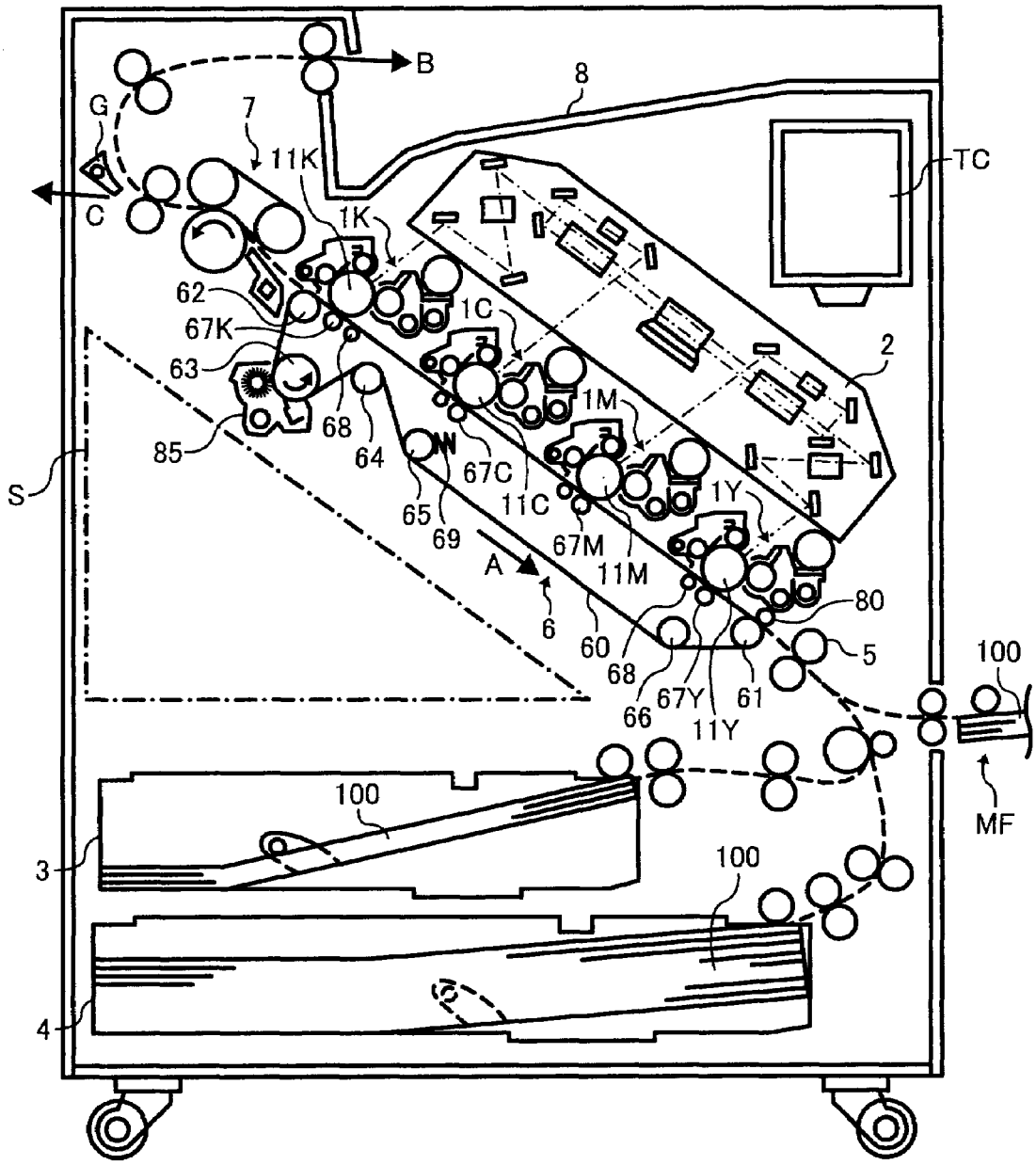
FIG. 1 is a schematic configuration diagram of a laser printer according to an embodiment of the present invention.
Figure 2:
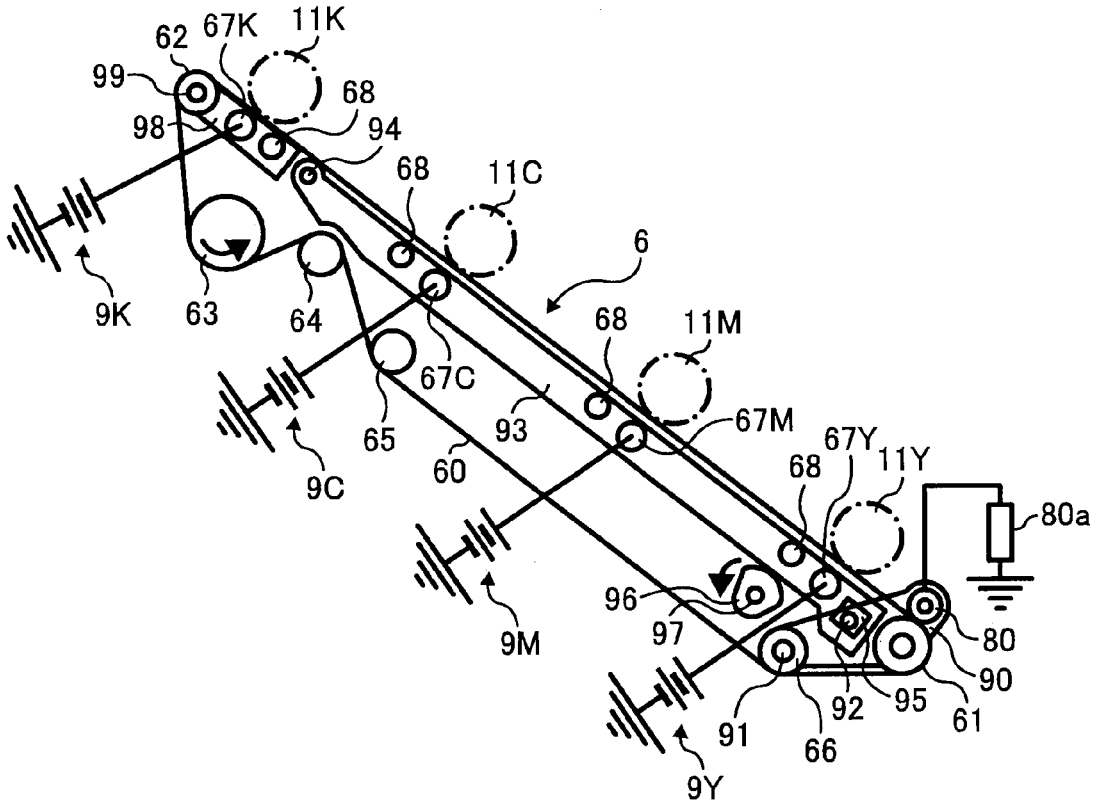
FIG. 2 is an enlarged schematic configuration diagram of a configuration of a transfer unit shown in FIG. 1.

FIG. 1 is a schematic configuration diagram of an electrophotographic direct transfer color laser printer (hereinafter, "laser printer"), to which an endless belt drive controlling apparatus according to an embodiment of the present invention is applied. FIG. 2 is a schematic configuration diagram of a transfer unit shown in FIG. 1.

With reference to FIG. 1, the laser printer is configured as follows. Four toner image forming units 1Y, 1M, 1C, and 1K (respective subscripts Y, M, C, and K indicate that the units are members for yellow, magenta, cyan, and black) for forming images in respective colors of yellow (Y), magenta (M), cyan (C), and black (K) are arranged in a moving direction of a transfer sheet 100, i.e., sequentially from an upstream side in a direction in which a transfer and transport belt 60 is moved along an arrow direction, A shown in FIG. 1. The toner image forming units 1Y, 1M, 1C, and 1K include photosensitive drums 11Y, 11M, 11C, and 11K serving as image carriers, and development units, respectively. The toner image forming units 1Y, 1M, 1C, and 1K are arranged so that rotation axes of the respective photosensitive drums 11Y, 11M, 11C, and 11K are parallel to one another, and so that the toner image forming units 1Y, 1M, 1C, and 1K are arranged at predetermined pitches in the moving direction of the transfer sheet 100.

The laser printer also includes an optical writing unit 2, sheet feed cassettes 3 and 4, a pair of registration rollers 5, a transfer and transport belt 60 serving as a transfer and transport member, the transfer unit 6 serving as a belt driver, a belt fixing type fixing unit 7, a sheet discharge tray 8, and the like. The transfer and transport belt 60 carries the transfer sheet 100, and transports the transfer sheet 100 so as to pass the transfer sheet 100 through a transfer position of each of the toner image forming units 1Y, 1M, 1C, and 1K. The transfer unit 6 includes the transfer and transport belt 60. Furthermore, the laser printer includes a manual feed tray MF and a toner supply container TC. In a space S indicated by a two-dot chain line, a waste toner bottle, a double-sided printing and reversal printing unit, a power supply unit, and the like are provided although not shown. The optical writing unit 2 includes a light source, a polygon mirror, an f–θ lens, a reflecting mirror, and the like.

The optical writing unit 2 irradiates a laser beam onto image carrying surface of the respective photosensitive drums 11Y, 11M, 11C, and 11K while scanning them relative to the laser light based on image data.

In FIG. 2, the transfer and transport belt 60 used in the transfer unit 6 is a high resistance endless single layer belt having a volume resistivity of $10^9$ to $10^{11}$ Ω·cm and consisting of, for example, polyvinylidene fluoride (PVDF). This transfer and transport belt 60 is spread over support rollers 61 to 68 so as to be passed through the respective transfer positions at which the transfer and transport belt 60 contacts and faces the photosensitive drums 11Y, 11M, 11C, and 11K of the respective toner image forming units 1Y, 1M, 1C, and 1K.

These support rollers 61 to 68 will be explained in detail. An electrostatic chuck roller 80 to which a predetermined voltage is applied from a power supply 80*a* is arranged outside of the transfer and transport belt 60 so as to face the entrance roller 61 provided upstream in the transfer sheet moving direction. The transfer sheet 100 passed through between the entrance roller 61 and electrostatic chuck roller 80 is electrostatically chucked on the transfer and transport belt 60. The transfer drive roller 63 frictionally drives the transfer and transport belt 60, is connected to a drive source (not shown), and is rotated in an arrow direction.

Transfer bias application members 67Y, 67M, 67C, 67K are provided as transfer field forming units that form a transfer field at each transfer position. The transfer bias application members 67K, 67M, 67C, 67K are arranged to contact with a rear surface of the transfer and transport belt 60. The transfer bias application members 67Y, 67M, 67C, 67K serve as bias rollers each having a sponge or the like provided on an outer periphery of the roller. A transfer bias is applied to cores of the bias rollers 67Y, 67M, 67C, 67K from transfer bias power supplies 9Y, 9M, 9C, and 9K, respectively. A transfer charge is applied to the transfer and transport belt 60 by an action of this applied transfer bias. The transfer field at a predetermined intensity is formed at each transfer position between the transfer and transport belt 60 and a surface of each of the photosensitive drums 11Y, 11M, 11C, 11K. In addition, each of the backup rollers 68 is arranged so as to appropriately keep a contact between the transfer sheet 100 and each of the photosensitive drums 11Y, 11M, 11C, 11K, and so as to provide a best transfer nip therebetween.

The transfer bias application members 67K, 67M, and 67C and the backup rollers 68 arranged near the respective transfer bias application members 67K, 67M, and 67C are held integrally by a rotation bracket 93, and formed rotatably about a rotation shaft 94. The members 67K, 67M, and 67C and their corresponding backup rollers 68 are rotated clockwise when a cam 96 fixed to a cam shaft 97 is rotated in an arrow direction.

The entrance roller 61 and the electrostatic chuck roller 80 are supported integrally by an entrance roller bracket 90, and formed rotatably about a shaft 91 clockwise from a state shown in FIG. 2. A hole 95 formed in the rotation bracket 93 is engaged with a pin 92 fixedly attached to the entrance roller bracket 90. The entrance roller bracket 90 is rotated sequentially with rotation of the rotation bracket 93. By rotating the entrance roller bracket 90 and roller bracket 93 clockwise, the bias application members 67Y, 67M, and 67C and the corresponding backup rollers 68 are separated from the respective photosensitive drums 11Y, 11M, and 11C, and the entrance roller 61 and the electrostatic chuck roller 80 are moved downward. By so operating, it is possible to avoid contact of the photosensitive drums 11Y, 11M, and 11C with the transfer and transport belt 60 if only a black image is to be formed.

On the other hand, the transfer bias application member 67K and the backup roller 68 adjacent to the transfer bias application member 67K are integrally supported by an exit bracket 98 and formed rotatably about a shaft 99 coaxial with the exit roller 62. If the transfer unit 6 is attached to or detached from an apparatus main body, the exit bracket 98 is rotated clockwise by operating a handle (not shown) so as to separate the transfer bias application member 67K and the backup roller 68 from the photosensitive drum 11K for forming a black image.

A cleaner 85 (see FIG. 1) constituted by a brush roller and a cleaning blade is arranged on an outer peripheral surface of the transfer and transport belt 60 wound on the transfer and transport roller 63 so as to contact with the outer peripheral surface thereof. This cleaner 85 removes foreign matters such as toners adhering onto the transfer and transport belt 60.

The support roller 64 is provided downstream of the transfer drive roller 63 in a moving direction of the transfer and transport belt 60 and in a direction in which the roller support 64 presses down the outer peripheral surface of the transfer and transport belt 60. By providing the roller support 64, a winding angle at which the transfer and transport belt 60 is wound on the transfer driver roller 63 is secured. The tension roller 65 that applies a tension to the transfer and transport belt 60 by a pressing member (spring) 69 is provided within a loop of the transfer and transport belt 60 downstream of the support roller 64.

Operations of the laser printer or image forming apparatus thus configured will be explained below. A broken line (dotted line) shown in FIG. 1 indicates a transport path of the transfer sheet 100. The transfer sheet 100 fed from the sheet feed cassette 3 or 4 or the manual feed tray MF is transported by transport rollers while being guided by a transport guide (not shown). In addition, the transfer sheet 100 is fed to a temporary stop position at which the paired registration rollers 5 are provided. The transfer sheet 100, which is fed to the temporary stop position, is fed forward by the paired registration rollers 5 at a predetermined timing, carried on the transfer and transport belt 60, transported toward the respective toner image forming units 1Y, 1M, 1C, and 1K, and passed through the respective transfer nips.

Toner images developed on the photosensitive drums 11Y, 11M, 11C, and 11K of the toner image forming units 1Y, 1M, 1C and 1K are registered on the transfer sheet 100 by their respective transfer nips, and transferred onto the transfer sheet 100 by actions of the transfer field and a nip pressure. By thus registering and transferring the respective toner images, a full-color toner image is transferred onto the transfer sheet 100. Surfaces of the photosensitive drums 11Y, 11M, 11C, and 11K after transfer of the toner images are cleaned by a cleaner and charge-neutralized for preparation of formation of a next electrostatic latent image.

The transfer sheet 100 onto which the full-color toner image is transferred is transported to the fixing unit 7, in which the full-color toner image is fixed onto the transfer sheet 100. The transfer sheet 100 onto which the full-color toner image is fixed is transported in a first sheet discharge direction B or a second sheet discharge direction C to correspond to a rotation attitude of a switching guide G. If the transfer sheet 100 is transported in the first sheet discharge direction B and discharged onto the sheet discharge tray 8, the transfer sheet 100 is stacked in a state where an image surface is turned downward, i.e., in a so-called facedown state. If the transfer sheet 100 is transported and discharged in the second sheet discharge direction B, the transfer sheet 100 is transported toward another post-processing unit (e.g., a sorter or a binder) (not shown). Alternatively, the transfer sheet 100 is transported toward the paired registration rollers 5 again for double-sided printing through a switch back unit. Thereafter, a full-color toner image is similarly formed on a rear surface of the transfer sheet 100 on which surface the image is not formed.

For such a tandem laser printer (tandem image forming apparatus), it is important to highly accurately register the toner images in the respective colors so as to prevent occurrence of out of color registration. However, a manufacturing error in several tens of micrometers occurs to each of the constituent elements, e.g., the transfer drive roller 63, the entrance roller 61, the exit roller 62, and the transfer and transport belt 60 of the transfer unit 6 at the time of manufacturing each element. This manufacturing error causes a fluctuation component generated when each component is rotated once to be transmitted onto the transfer and transport belt 60. The fluctuation component thus transmitted changes a sheet transport velocity. As a result, timings at which the toners on the respective photosensitive drums 11Y, 11M, 11C, and 11K are transferred onto the transfer sheet 100 are slightly deviated from one another. This timing deviation often causes the occurrence of the out of color registration in a sub-scan direction. For the image forming apparatus that forms an image in microdots at, for example, 1200×1200 DPI, in particular, a timing deviation of a few micrometers is recognized as the out of color registration. To prevent this, according to this embodiment, an encoder is provided on the encoder roller 66, a rotational velocity of the encoder is detected, and the rotation of the transfer drive roller 63 is feedback controlled by the detected rotational velocity of the encoder. The transfer and transport belt 60 is thereby allowed to be moved at a constant velocity.

Figure 3:
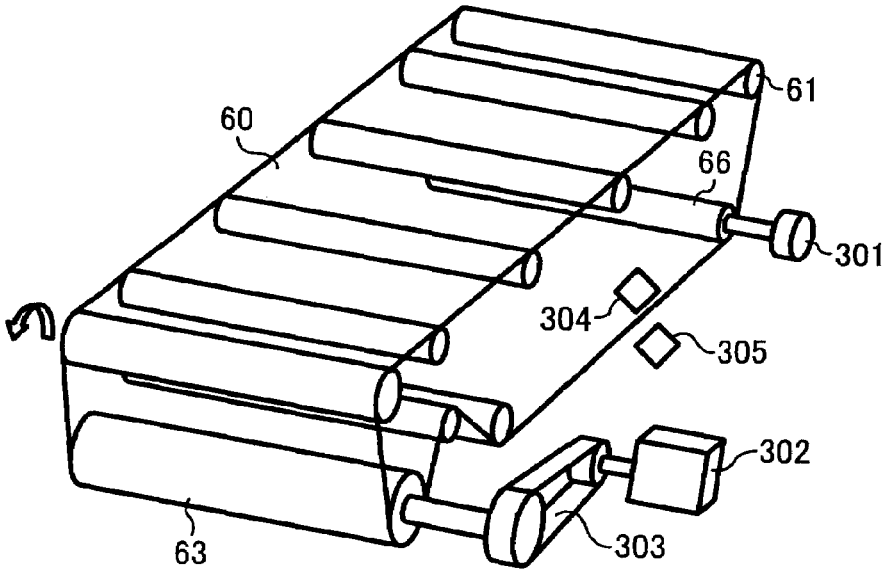
FIG. 3 is a configuration diagram of an arrangement of principal constituent elements of the transfer unit.

FIG. 3 is a schematic configuration diagram of principal constituent elements of the transfer unit 6 in the image forming apparatus according to this embodiment so as to show the arrangement of the constituent elements. In FIG. 3, the transfer drive roller 63 is coupled with a drive gear of a transfer drive motor 302 through a timing belt 303. If the drive motor 302 drives the transfer drive roller 63 to be rotated, the transfer drive roller 63 is rotated proportionally with a driving speed of the transfer drive motor 302. By rotating the transfer drive roller 63, the transfer and transport belt 60 is driven. By driving the transfer and transport belt 60, the encoder roller 66 is rotated.

In this embodiment, an encoder 301 is provided on the shaft of the encoder roller 66. By allowing the encoder 301 to detect the rotational velocity of the encoder roller 66, the speed of the transfer drive motor 302 is controlled. This control is exercised so as to prevent the disadvantage that the out of color registration occurs due to a change in the velocity of the transfer and transport belt 60, and to minimize the change in the velocity of the transfer and transport belt 60.

Figure 4:
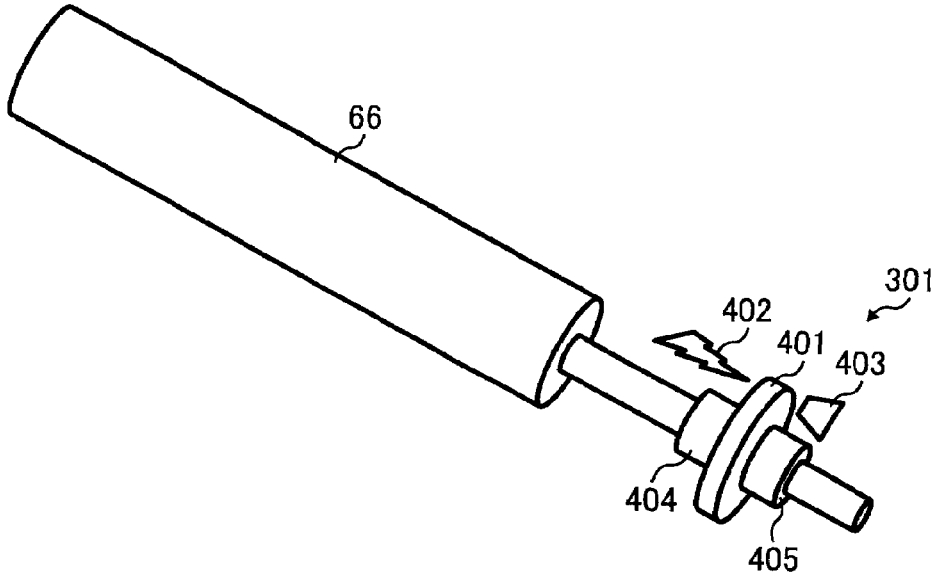
FIG. 4 is a detailed view of an encoder roller and an encoder.

FIG. 4 is a detailed view of the encoder 301 provided on the shaft of the encoder roller 66. The encoder 301 mainly includes a disc 401, a light emitting element 402, a light receiving element 403, and press-fit bushings 404 and 405. The disc 401 is fixed by press-fitting the press-fit bushings 404 and 405 onto the shaft of the encoder 301, and rotated according to the rotation of the encoder roller 66. A slit (not shown) for transmitting a light in a circumferential direction of the disc 401 at a resolution in several hundreds is provided in the disc 401. The light emitting element 402 and the light receiving element 403 are arranged on both sides of the slit, respectively so as to put this slit therebetween. By so configuring the encoder 301, a pulsed ON or OFF signal is obtained according to a rotation amount of the encoder roller 66. Using this pulsed ON or OFF signal, the encoder 301 detects a moving angle (hereinafter, "an angular displacement") of the encoder roller 66. Based on the detected angular displacement of the encoder roller 66, a drive amount of the transfer drive motor 302 is controlled.

Furthermore, a belt mark 304 is attached to non-image forming region on the surface of the transfer and transport belt 60 for managing a reference position of the transfer and transport belt 60. A sensor 305 provided to face this belt mark 304 detects whether the belt mark 304 is ON or OFF. By detecting this, the encoder 301 is prevented from detecting the velocity change of the transfer and transport belt 60 due to a change in an effective radius of the encoder roller 66, i.e., drive roller resulting from an irregularity in a thickness of the transfer and transport belt 60 although the velocity of the transfer and transport belt 60 is actually constant. To do so, a detected angular displacement error generated by a change in the thickness of the transfer and transport belt 60 and measured in advance is added to a desired control value. Using an addition result as the desired control value, the transfer and transport belt 60 is feedback controlled to be moved at the constant velocity. The belt mark 304 is provided so as to make an actual belt position correspond to a position of the detected angular deviation error.

In a proportional control operation, the difference between the desired angular displacement and the detected angular displacement per control cycle is multiplied by the control gain, and the driving speed of the drive motor is controlled based on the multiplication result. Due to this, if the detected angular displacement error due to the thickness of the transfer and transport belt 60 is great, the more amplified drive motor is driven. As a result, the change in the velocity of the transfer and transport belt 60 is generated according to the thickness of the transfer and transport belt 60, and the out of color registration occurs accordingly.

Figure 18:
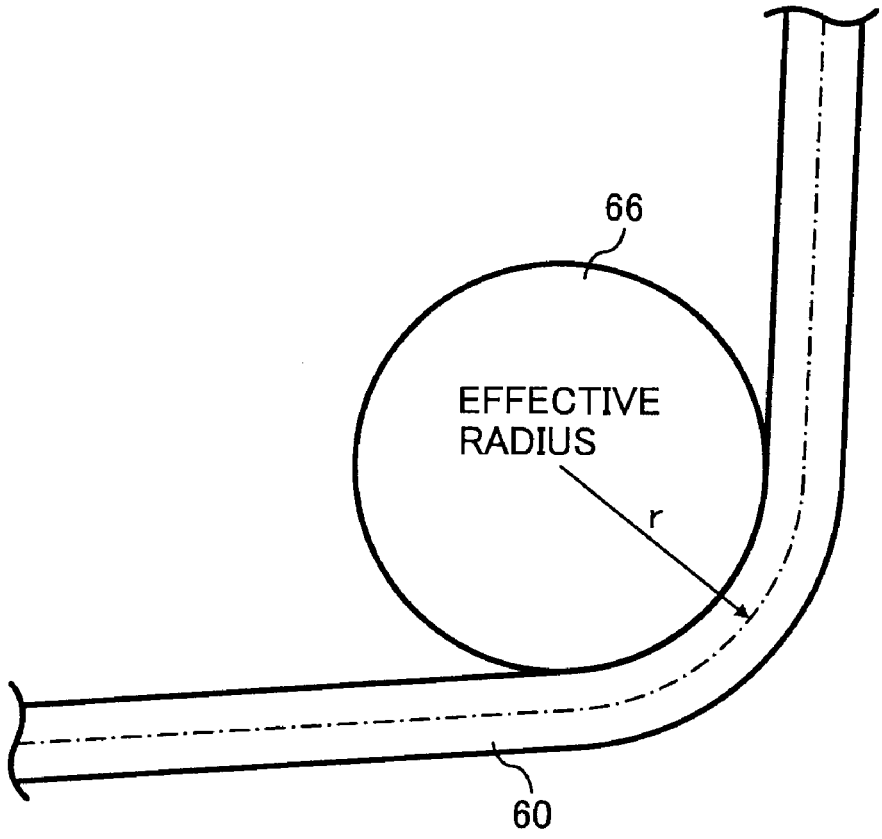
FIG. 18 is a schematic diagram of a position of a belt thickness effective line.

Namely, it is assumed, for example, when the transfer drive motor 302 is driven at a constant speed, the transfer and transport belt 60 is moved ideally without the change in the velocity thereof and the thick portion of the transfer and transport belt 60 is wound on the encoder roller 66. If so, the effective radius r of the encoder roller or driven roller 66 shown in FIG. 18 is increased, the rotation angular displacement of the encoder roller 66 per constant time is reduced, and the reduction in the rotation angular displacement is detected as a reduction in belt moving velocity. On the other hand, if the thin portion of the transfer and transport belt 60 is wound on the encoder roller 66, then the rotation angular displacement of the encoder roller 66 is increased, and the increase in the rotation angular displacement is detected as an increase in the belt moving velocity.

These cases relate to behaviors if the transfer drive motor 302 is driven at the constant speed. In other words, it suffices to drive the transfer drive motor 302 so that a count value of the encoder 301 is sampled at a constant timing. By doing so, even if the effective radius r of the encoder roller or driven roller 66 shown in FIG. 18 is changed, the encoder roller 66 is rotated at the constant velocity.

Thus, it is preferable to control the transfer and transport belt 60 to have the constant velocity by generating the desired angular displacement per control cycle and controlling the encoder 301 according to the desired angular displacement. To this end, not the measured actual thickness of the transfer and transport belt 60 in micrometers but a phase and an amplitude of the transfer and transport belt 60 at the position of the belt mark 304 are used as control parameters for the detected angular displacement error of the encoder 301 in radians generated due to the thickness change of the transfer and transport belt 60.

An actual detection output of the encoder 301 includes not only the detected angular displacement error of the encoder roller 66 due to the thickness change of the transfer and transport belt 60 but also change and rotational eccentricity components of the transfer drive roller 63 and of the other constituent elements. Due to this, a process for extracting only the components influenced by the encoder roller or driven roller 66 from the output of the encoder 301, and the extracted components are used as the control parameter for the detected angular displacement error.

Figure 5:
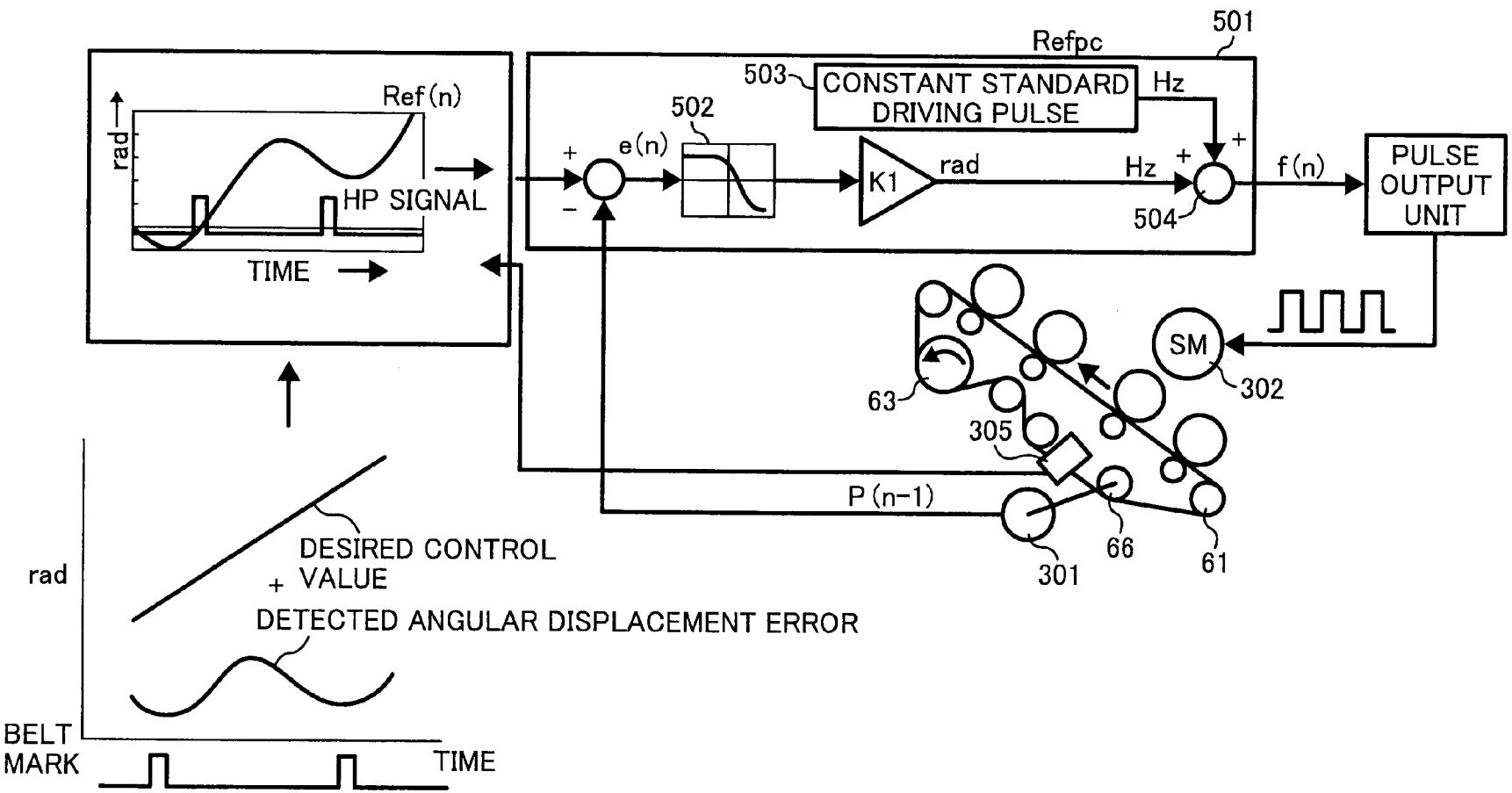
FIG. 5 is a block diagram of a drive control apparatus for carrying out a drive control method.

FIG. 5 is a block diagram of an endless belt drive controlling apparatus according to this embodiment.

In FIG. 5, the position error e(n) between the desired angular displacement Ref(n) and the detected angular displacement P(n−1) of the encoder 301 is input to a controller unit 501. This controller unit 501 mainly includes a low pass filter 502, which eliminates high frequency noise, and a proportional element (having a proportional gain Kp) 503. The controller unit 501 calculates a correction amount relative to a standard driving pulse frequency used to drive the transfer drive motor 302, and outputs the calculated correction amount to an operation unit 504. The operation unit 504 adds the correction amount to a constant standard driving pulse frequency Refpc to thereby determine a driving pulse frequency f(n).

The desired angular displacement Ref(n) is generated by adding the detected angular displacement error generated due to the thickness change of the transfer and transport belt 60 to a desired control value. The position error e(n) between this desired angular displacement Ref(n) and the detected angular displacement P(n−1) of the encoder 301 is calculated, thereby computing a differential displacement. The detected angular displacement error generated due to the thickness change of the transfer and transport belt 60 is repeatedly added to the desired control value at periodic intervals according to a timing of a detection output of the sensor 305 according to the rotation of the transfer and transport belt 60.

This detected angular displacement error is generated according to a moving distance of the transfer and transport belt 60 from the position of the belt mark 304 by the following computing equation using the phase and the amplitude of the transfer and transport belt 60 at the position of the belt mark 304 measured in advance and serving as the control parameters for the detected angular displacement error.

$$(\text{Detected angular displacement error})=b\times\sin(2\times\pi\times ft+\tau)$$

In the equation, b denotes the amplitude, τ denotes the phase, f denotes a frequency at which the transfer and transport belt 60 is revolved once, and t denotes a time for which the transfer and transport belt 60 is moved from the belt mark 304. The computed value is used as the detected angular displacement error, the detected angular displacement error is added to the desired control value according to the time t at which the transfer and transport belt 60 is moved from the belt mark 304. The belt frequency f is computed using a fixed value uniquely determined by a mechanical layout of the transfer unit 6 and the belt moving velocity.

By thus feedback controlling the transfer and transport belt 60 using the desired control value according to the thickness change of the transfer and transport belt 60, the transfer and transport belt 60 can be moved at the constant moving velocity without being influenced by the thickness change of the transfer and transport belt 60.

Actually, however, as explained, if the transfer and transport belt 60 is left stopped for a long time, the thickness of the transfer and transport belt 60 is changed depending on a tension (pressure) applied to the transfer and transport belt 60 for absorbing an extension or a contraction of the belt perimeter. If the transfer and transport belt 60 is left stopped particularly in a state where the tension is applied to the thin portion of the transfer and transport belt 60, then the thin portion is made further thinner, and a thickness deviation is greater. In this state, if the transfer and transport belt 60 is feedback controlled using the control parameters acquired when the thickness deviation is not changed, a difference is generated between the belt thickness deviation at the time of acquiring the control parameters and that when the transfer and transport belt 60 is actually feedback controlled. If so, a difference or an error conventionally occurs to the controlled variable. This error makes it impossible to set the belt moving velocity constant.

This error conventionally results from the fact that the control parameters are measured only when the transfer and transport belt 60 is attached and that the same control parameters are used as long as the transfer and transport belt 60 is not replaced with a different one on the presumption that the belt thickness is not changed.

Nevertheless, as explained, particularly if the transfer and transport belt 60 is left stopped for a long time, then the transfer and transport belt 60 is extended and the thickness deviation is changed. It is, therefore, actually necessary to prepare the control parameters according to the change in belt thickness.

Due to this, if the state where the transfer and transport belt 60 is left stopped for a certain time continues, it is necessary to perform a control parameter measurement operation.

To measure the control parameters, the process for extracting only the components erroneously detected by the encoder 301 and influenced by the encoder roller 66 due to the change in the belt thickness from the output result of the encoder 301 that is obtained when the transfer and transport belt 60 is moved at the constant velocity is performed. In this process, it is necessary to eliminate not only the change components of the transfer and transport belt 60 that is revolved once but also changed components of the other driven rollers, the influence of the meandering of the transfer and transport belt 60, and the like. To do so, data sampling by revolving the transfer and transport belt 60 at least four times and averaging needs to be performed on the output result of the encoder 301.

That is, to measure the control parameters, it is necessary to revolve the transfer and transport belt 60 at least four times. If the measurement operation is performed whenever the transfer and transport belt 60 is activated after the transfer and transport belt 60 is left stopped for the certain time, a print start time right after the activation is increased, accordingly. This gives a user a waiting time. If the user is to obtain a print result, the user is forced to wait until a measurement result is actually printed, thereby making the user feel uncomfortable.

To avoid this disadvantage, according to this embodiment, the transfer and transport belt 60 is always stopped at a predetermined stop position, or particularly the thick portion of the transfer and transport belt 60 is stopped at a position at which the tension is applied to the transfer and transport belt 60. By minimizing the extension of the transfer and transport belt 60 even if the transfer and transport belt 60 is left stopped, the change in thickness deviation is minimized. Since this operation is the most characteristic operation of the present invention, it will be explained below in detail.

Figure 6:
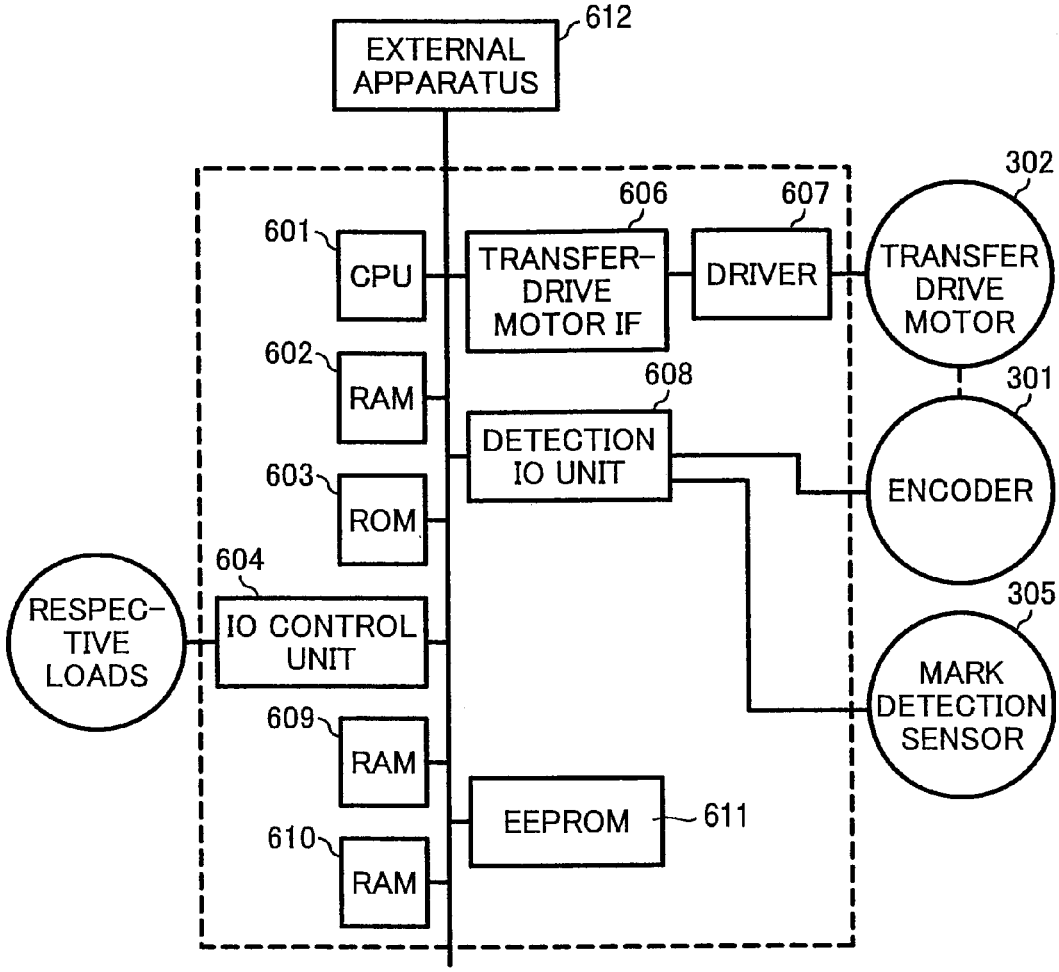
FIG. 6 is a block diagram of a hardware configuration of a transfer drive motor control system and controlled elements.

FIG. 6 is a block diagram of a hardware configuration of a control system for controlling the transfer drive motor 302 and controlled elements according to this embodiment. The control system shown in FIG. 6 digitally controls the driving pulse of the transfer drive motor 302 based on the output signal of the encoder 301. The control system mainly includes a central processing unit (CPU) 601, a random access memory (RAM) 602, a read only memory (ROM) 603, an input and output (IO) control unit 604, a transfer drive motor interface IF unit 606, a driver 607, a detection IO unit 608, RAMs 609 and 610, and an electrically erasable, programmable read only memory (EEPROM) 611.

The CPU 601 controls an entirety of the image forming apparatus including a control over reception of image data input from an external apparatus 612 and a control over transmission and reception of control commands. The RAM 602, the ROM 603 that stores a program, the IO control unit 604, and the like are connected to one another through a bus. In response to a control command from the CPU 601, a data read and write processing and operations of various elements such as a motor, a clutch, a solenoid, and a sensor for driving respective loads are executed. The transfer drive motor IF 606 outputs a command signal for instructing the driving frequency of a driving pulse signal to the transfer drive motor 302 through the driver 607 in response to a driving command from the CPU 601. The transfer drive motor 302 is driven to be rotated according to this frequency, so that a variable driving speed control can be exercised over the transfer drive motor 302.

The output signal of the encoder 301 is input to the detection IO unit 608. The detection IO unit 608 processes output pulses of the encoder 301 to convert the pulses into a digital value. This detection IO unit 608 includes two counters for counting the output pulses of the encoder 301. One of them is an encoder pulse counter 1 that counts accumulated output pulses of the encoder 301. The other is an encoder pulse counter 2 that counts a moving distance of the transfer and transport belt 60 by which the transfer and transport belt 60 is moved from the belt mark 304. The encoder pulse counter 2 is cleared to zero according to the timing at which the sensor 305 detects the belt mark 304, and counts the moving distance of the transfer and transport belt 60 from the belt mark 304 detected by the sensor 305. A numeric value obtained as a count value of the encoder pulse counter 1 is multiplied by a preset conversion constant for conversion of the number of pulses into an angular displacement. The output pulses are thereby converted into the digital numeric value corresponding to the angular displacement of the encoder roller 66. A signal indicating the digital value corresponding to the angular displacement of the disc 401 is transmitted to the CPU 601 through the bus.

The CPU 601 includes a control cycle timer for determining a control interval at which the transfer drive motor 302 is feedback controlled. According to this control interval, the desired angular displacement (desired control value) of the encoder roller 66 is computed at an appropriate time. The transfer drive motor controlled variable is determined based on the difference between this desired control value and the detected angular displacement of the encoder roller 66. In this embodiment, the control cycle timer of the CPU 601 operates in a control cycle of 1.6 milliseconds.

The transfer drive motor IF 606 generates a pulsed control signal at the driving frequency based on the driving frequency command signal transmitted from the CPU 601. The driver 607 includes a power semiconductor device (e.g., a transistor) and the like. This driver 607 operates based on the pulsed control signal output from the transfer drive motor IF 606, and applies a pulsed control voltage to the transfer drive motor 302. As a result, the transfer drive motor 302 is controlled to be driven at the predetermined driving frequency output from the CPU 601. The angular displacement of the disc 401 of the encoder roller 66 is thereby follow-up controlled to follow up the desired angular displacement, and the encoder roller 66 is rotated at a predetermined constant angular velocity. The angular displacement of the disc 401 is detected by the encoder 301 and the detection IO unit 608, and input to the CPU 601. Thus, the transfer drive motor 302 is repeatedly controlled.

Figure 7:
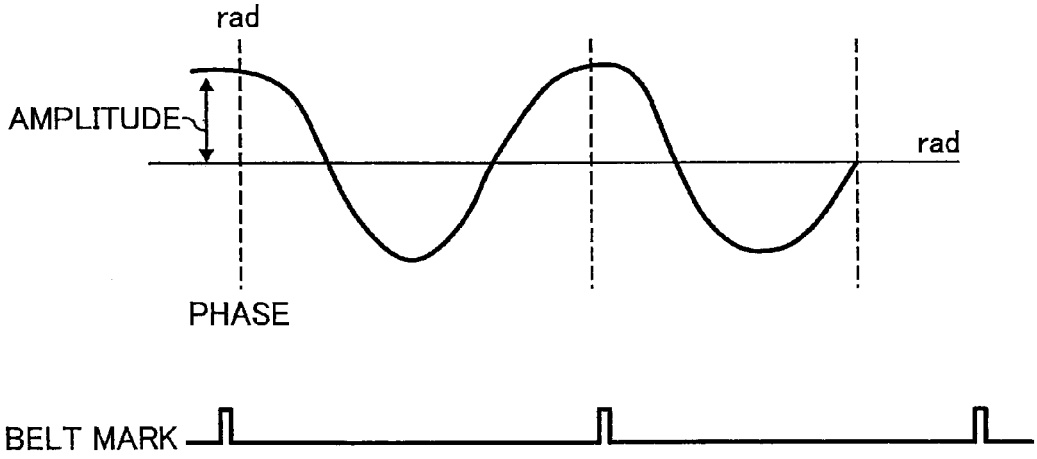
FIG. 7 is a graph of phase and amplitude parameters of a belt.

The EEPROM 611 stores the phase and amplitude parameters of the transfer and transport belt 60 as shown in FIG. 7. If the transfer drive motor 302 is driven, data on the transfer and transport belt 60 that is revolved once is expanded onto the RAM 609 at an arbitrary time using an SIN function or approximate equation. If the transfer drive motor 302 is actually driven, the data is read with a reference address of the RAM 609 switched over according to the count value of the encoder pulse counter 2 at the timing at which the sensor 305 detects the belt mark 304. The read data is added to the desired control angular displacement, thereby generating the desired control value corresponding to the thickness of the transfer and transport belt 60.

However, if the thickness deviation of the transfer and transport belt 60 is changed according to the stop position of the transfer and transport belt 60 and the time for leaving the transfer and transport belt 60 stopped before the transfer and transport belt 60 is activated next time, the amplitude stored in the EEPROM 611 is often deviated from an actual amplitude of the transfer and transport belt 60.

This is because the change amount of the transfer and transport belt 60 differs between a case that the transfer and transport belt 60 is left stopped in the state where the thin portion of the transfer and transport belt 60 is located at the position of the tension roller 65 and a case that the transfer and transport belt 60 is left stopped in the state where the thick portion thereof is located at the position of the tension roller 65. If the thin portion of the transfer and transport belt 60 is located at the position of the tension roller 65, the change amount is characteristically particularly large. Due to this, according to this embodiment, if the transfer and transport belt 60 is stopped, the transfer and transport belt 60 is controlled so that the thick portion of the transfer and transport belt 60 having the small change amount is located at the position of the tension roller 65. By doing so, the change in the thickness deviation of the transfer and transport belt 60 is reduced and the change in the velocity of the transfer and transport belt 60 is minimized, accordingly. By so controlling, the transfer and transport belt 60 is revolved one more extra time depending on a stop request timing during rotation of the transfer and transport belt 60 at worst. Nevertheless, since the print operation is already finished when the transfer and transport belt 60 is stopped, the moving change of the transfer and transport belt 60 can be minimized without making the user feel uncomfortable. In addition, it is unnecessary to remeasure the control parameters whenever the transfer and transport belt 60 is left stopped.

An operation in the case that the transfer and transport belt 60 is stopped will be explained with reference to FIGS. 19A and 19B.

Figure 19A:
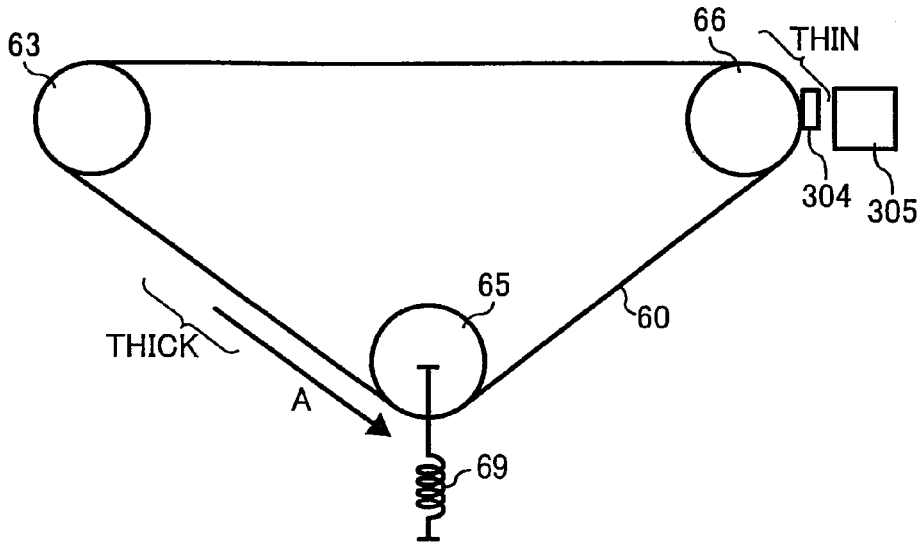
FIG. 19A is a schematic configuration diagram of the transfer unit.
Figure 19B:
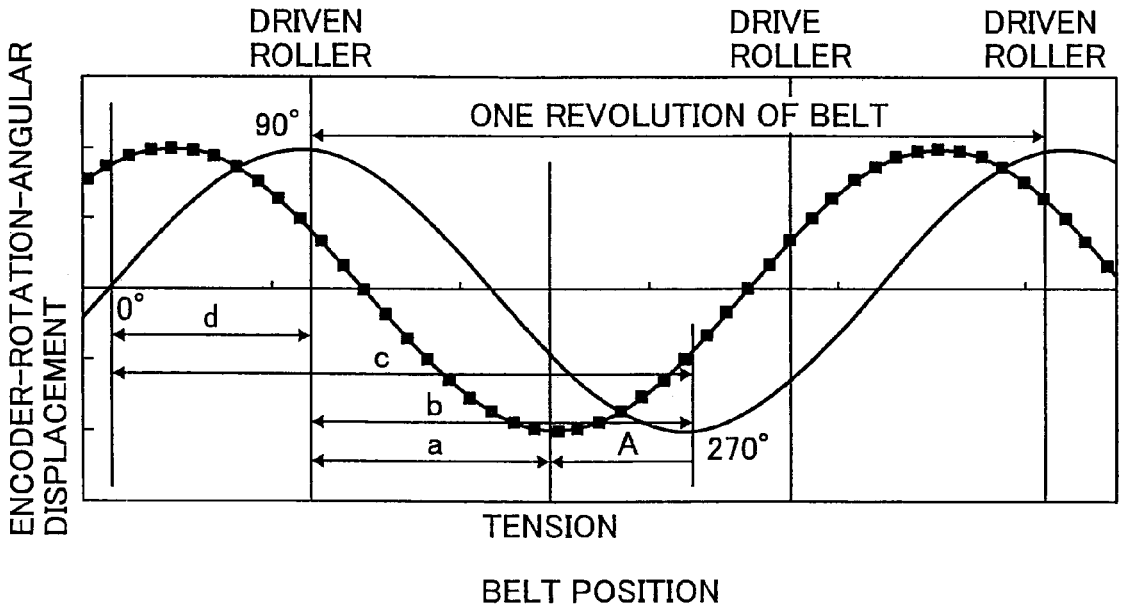
FIG. 19B is a graph of a relationship between each roller position and an angular displacement of the encoder.

FIG. 19A is a schematic configuration diagram of the configuration of the transfer unit 6. With reference to FIG. 19A, the sensor 305 is arranged at the position at which the encoder 301 is attached to the encoder roller 66. It is assumed herein that a request to stop the transfer and transport belt 60 is transmitted when the transfer and transport belt 60 having an amplitude of 90 degrees as stored in the EEPROM 611 and the belt mark 304 is located at the position of the sensor 305. If so, a relationship is held between a position of each roller and the angular displacement of the encoder 301 as shown in FIG. 19B. As shown in FIG. 19A, the portion in which the angular displacement of the encoder 301 is large, i.e., the thin portion of the transfer and transport belt 60 is located at the position of the encoder roller 66, at which position the sensor 305 is also provided. In addition, the portion in which the angular displacement of the encoder 301 is small, i.e., the thick portion of the transfer and transport belt 60 is located at an intermediate position between the tension roller 65 and the transfer drive roller 63.

At this time, the distance from the position of the sensor 305 to the thick portion of the belt transfer and transport 60 is b. The distance b can be calculated as follows. A distance d from a position at which the phase of the transfer and transport belt 60 is 0 degree to the position of the belt mark 304 at which the phase of the transfer and transport belt 60 is 90 degrees is subtracted from a distance c from the position at which the phase of the transfer and transport belt 60 is 0 degree to the thickest portion of the transfer and transport belt 60 at which the phase thereof is 270 degrees. If a distance by which the transfer and transport belt 60 is revolved once is assumed as 815 millimeters, the distances c, d, and b are represented as follows.

$$c=815\times270/360=611 \text{ millimeters}$$

$$d=815\times90/360=203 \text{ millimeters}$$

$$b=c-d=611-203=407 \text{ millimeters}$$

Thus, the distance b from the position of the sensor 305 to the thick portion of the transfer and transport belt 60 is 407 millimeters.

A distance A from the thick portion of the transfer and transport belt 60 to the position of the tension roller 65 is finally obtained. Thus, the thick portion of the transfer and transport belt 60 can be stopped at the position of the tension roller 65 by performing a through-down process if the counter value of the encoder pulse counter 2 that counts the distance, by which the transfer and transport belt 60 is revolved once, is equal to a value corresponding to the distance A.

The distance A from the thick portion of the transfer and transport belt 60 to the position of the tension roller 65 can be calculated as follows. A distance a from the position of the sensor 305 to that of the tension roller 65 is subtracted from the distance b from the position of the sensor 305 to the thick portion of the transfer and transport belt 60. The distance b from the position of the sensor 305 to the thick portion of the transfer and transport belt 60 is 407 millimeters according to the previous calculation. The distance a from the position of the belt mark sensor 305 to that of the tension roller 65 is a value uniquely determined by the mechanical layout of the transfer unit 6, and assumed as 271 millimeters. If so, the distance A is calculated as follows.

$$A=b-a=407-271=136 \text{ millimeters}$$

If a resolution of the encoder 301 is 300 pulses per revolution of the transfer and transport belt 60, and a diameter of the encoder roller 66, to which the encoder 301 is attached, is 15.586 millimeters, the moving distance of the transfer and transport belt 60 per pulse is calculated as follows.

$$15.586\times\pi/300=163 \text{ (micrometers)}$$

Therefore, the distance A of 136 millimeters is converted into the count value of the encoder pulse counter 2 as follows.

$$1000\times136/163=834 \text{ counts}$$

Namely, if a process for stopping the transfer and transport belt 60 is performed if the value of the encoder pulse counter 2 is 834, the thick portion of the transfer and transport belt 60 is stopped at the position of the tension roller 65.

Figure 8:
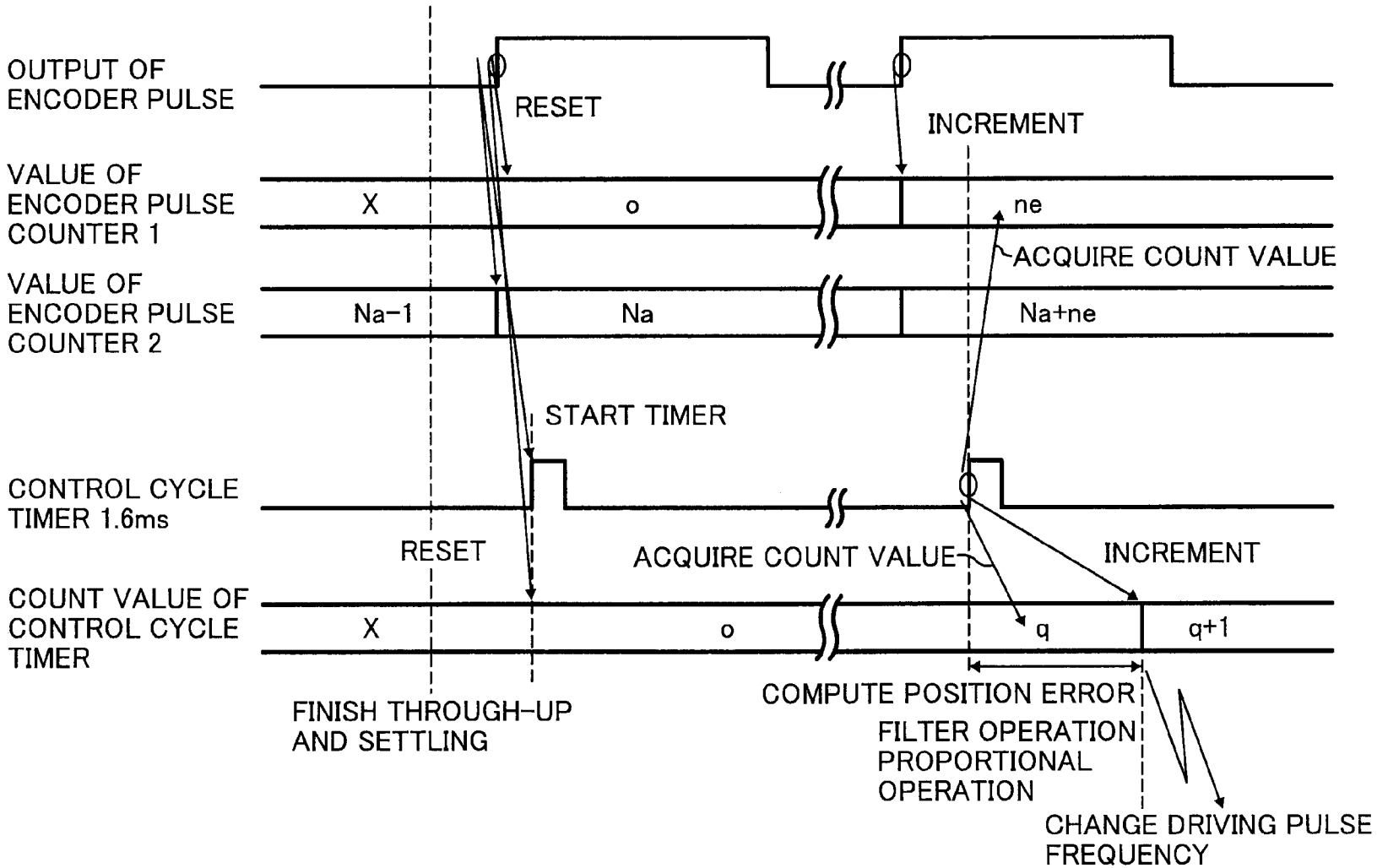
FIG. 8 is a timing chart for realizing a drive control.
Figure 9:
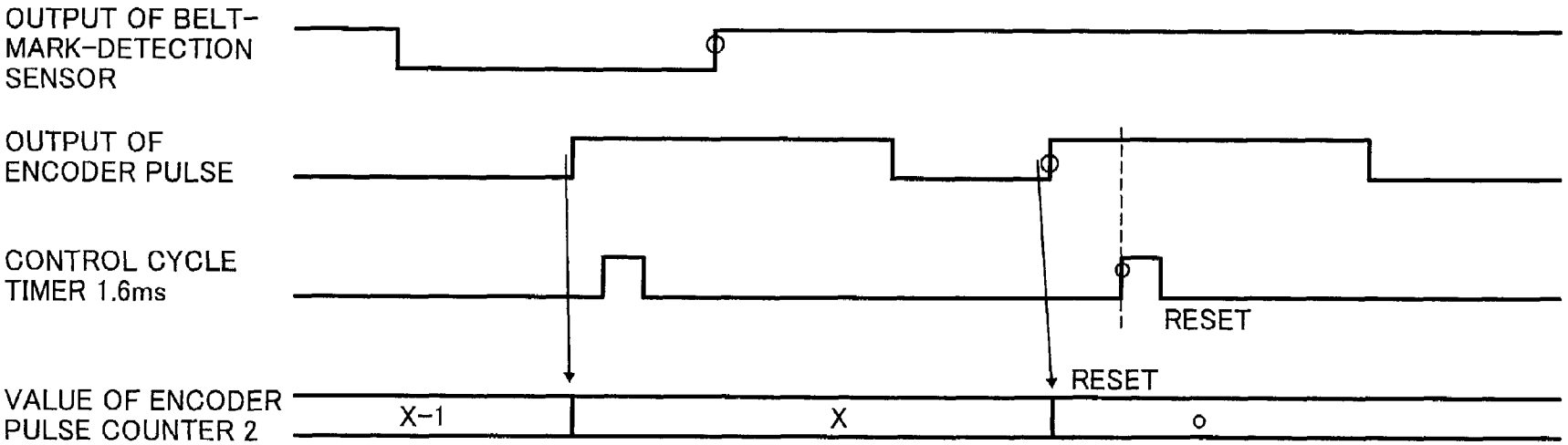
FIG. 9 is a timing chart for realizing the drive control.

FIGS. 8 and 9 are timing charts for realizing the control over the endless belt according to this embodiment.

With reference to FIGS. 8 and 9, the count value of the encoder pulse counter 1 is incremented at a rising edge of a phase-A output of an encoder pulse. The control cycle according to this embodiment is 1.6 microseconds. The count value of the control cycle timer included in the CPU 601 is incremented whenever an interrupt of the control cycle timer occurs to the CPU 601. The control cycle timer is started when the rising edge of the encoder pulse is detected for the first time after end of through-up and settling of the transfer drive motor 302. At the start of the control cycle timer, the count value of the control cycle timer is reset.

Furthermore, whenever the control cycle timer interrupts the CPU 601, the count value ne of the encoder pulse counter 1 is acquired and the count value q of the control cycle timer is incremented.

Similarly to the encoder pulse counter 1, the encoder pulse counter 2 is incremented at the rising edge of the phase A output of the encoder pulse. The encoder pulse counter 2 is reset when the detection value of the sensor 305 is input. Due to this, the encoder pulse counter 2 substantially counts the moving distance of the transfer and transport belt 60 from the belt mark 304. According to this count value, the reference address of the RAM 609 that stores the data on the desired control profile by as much as the revolution of the transfer and transport belt 60 once is switched over, and AO is acquired while referring to the detected angular displacement error.

Based on the respective count values, the position error e(n) is computed as shown below.

$$e(n)=\theta 0\times q+(\Delta\theta-\Delta\theta_0)-\theta 1\times ne(\text{radians})$$

e(n) [rad]: Position error (computed by this sampling)

θ0 [rad]: Moving angle ($=2\pi\times V\times 10^{-3}/l\pi$ [rad]) per control cycle [ms]

Δθ [rad]: Rotation angular velocity change [$=b\times\sin(2\times\pi\times n\times ft+\tau)$ (table reference value) of the encoder roller or driven roller 66

$\Delta\theta_0$ [rad]: First acquired AO after activation of the drive motor 302

θ1 [rad]: Moving angle ($=2\pi/p$ [rad]) per encoder pulse q: Count value of control cycle timer V: Belt linear velocity [mm/s]

l: Diameter of encoder roller [mm]

b: Amplitude changed according to belt thickness [rad]

τ: Phase of belt at belt mark in belt thickness change [rad]

f: Cycle of belt thickness change [Hz]

In this embodiment, the diameter ϕ of the encoder roller or driven roller 66, to which the encoder 301 is attached, is 15.515 millimeters, and the belt thickness is 0.1 millimeters. If the driven roller 66 is driven to be rotated by friction, the diameter I is represented as follows while assuming that about half of the substantial belt thickness corresponds to that of a core around which the driven roller 66 is rotated.

$$I=15.515+0.1=15.615 \text{ millimeters}$$

In addition, in this embodiment, it is assumed that the resolution p of the encoder 301 is 300 pulses per resolution.

To avoid a response to a sudden positional change, a filter operation having the following specifications is performed on the computed position error e(n).

Filter type: Butterworth IIR low pass filter

Sampling frequency: 1 kilohertz (equal to the control cycle)

Pass band ripple (Rp): 0.01 decibel

Stop band end attenuation (Rs): 2 decibels

Pass band end frequency (Fp): 50 hertz

Stop band end frequency (Fs): 100 hertz

Figure 10:
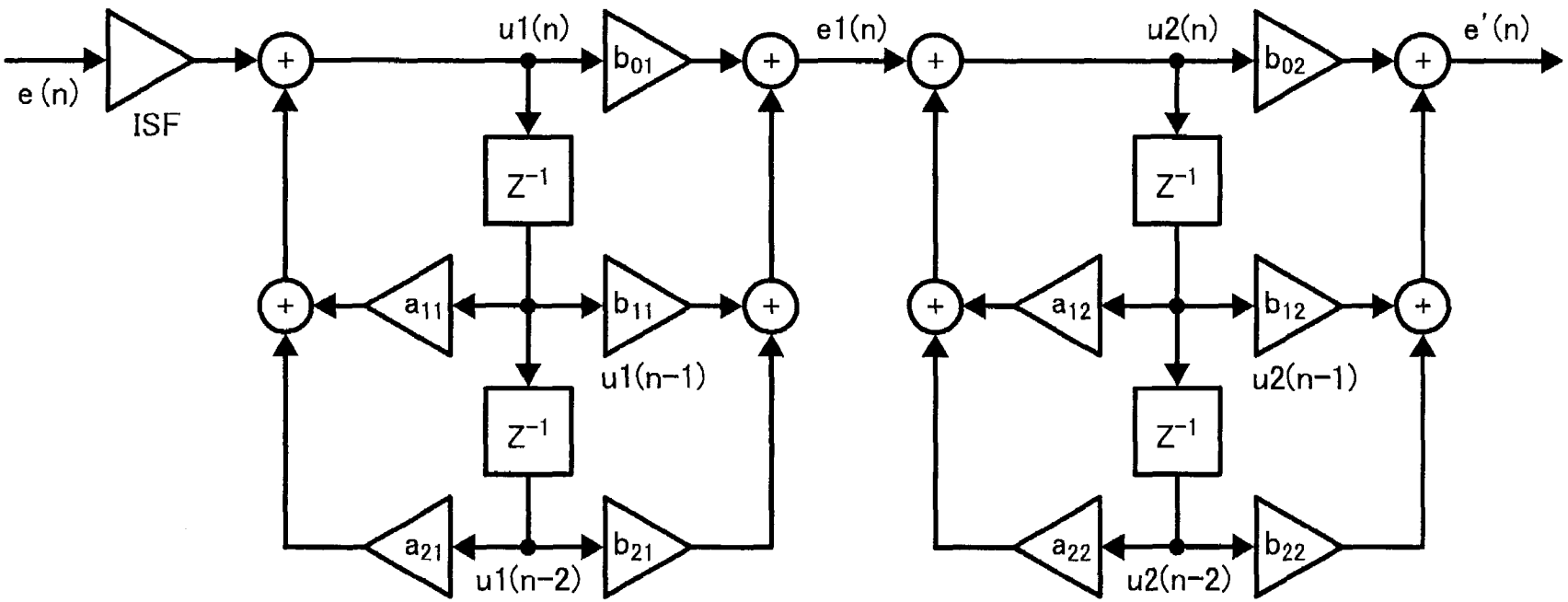
FIG. 10 is a block diagram of a filter operation.
Figures 11, 12:
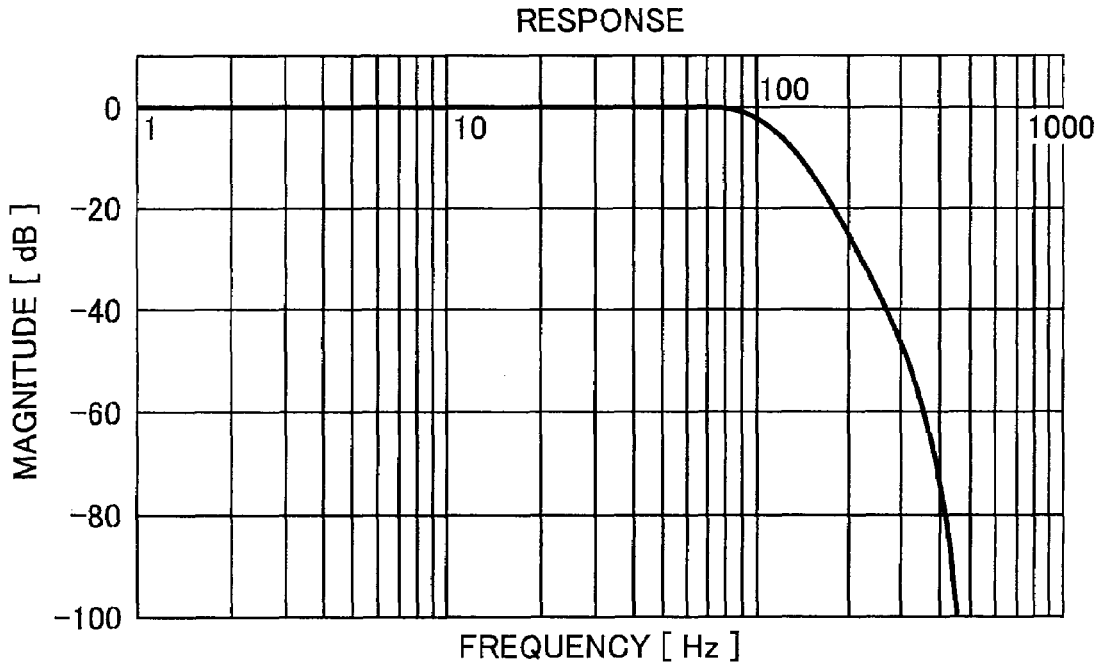
FIG. 11 is a table of a list of filter coefficients.
FIG. 12 is a graph of amplitude characteristics of a filter.

FIG. 10 is a block diagram of a filter used in the filter operation according to this embodiment, and FIG. 11 is a table of a list of filter coefficients. It is assumed herein that the filter includes double cascades. It is also assumed that u1(n), u1(n−1), and u1(n−2) are set as intermediate nodes of a first cascade, and that u2(n), u2(n−1), and u2(n−2) are set as those of a second cascade. Meanings of the indexes are as follows:

(n): Present sampling (n−1): Sampling one operation before present sampling (n−2): Sampling two operations before present sampling It is assumed that the following program operation is performed whenever an interrupt of the control timer occurs during the feedback control.

$$u1(n)=a11\times u1(n-1)+a21\times u1(n-2)+e(n)\times ISF$$

$$e1(n)=b01\times u1(n)+b11\times u1(n-1)+b21\times u1(n-2)$$

$$u1(n+2)=u1(n+1)$$

$$u1(n+1)=u1(n)$$

$$u2(n)=a12\times u2(n-1)+a22\times u2(n-2)+e1(n)$$

$$e'(n)=b02\times u2(n)+b12\times u2(n-1)+b22\times u2(\text{n}-2)$$

$$u2(n-2)=u2(n-1)$$

$$u2(n-1)=u2(n)$$

Figure 13:
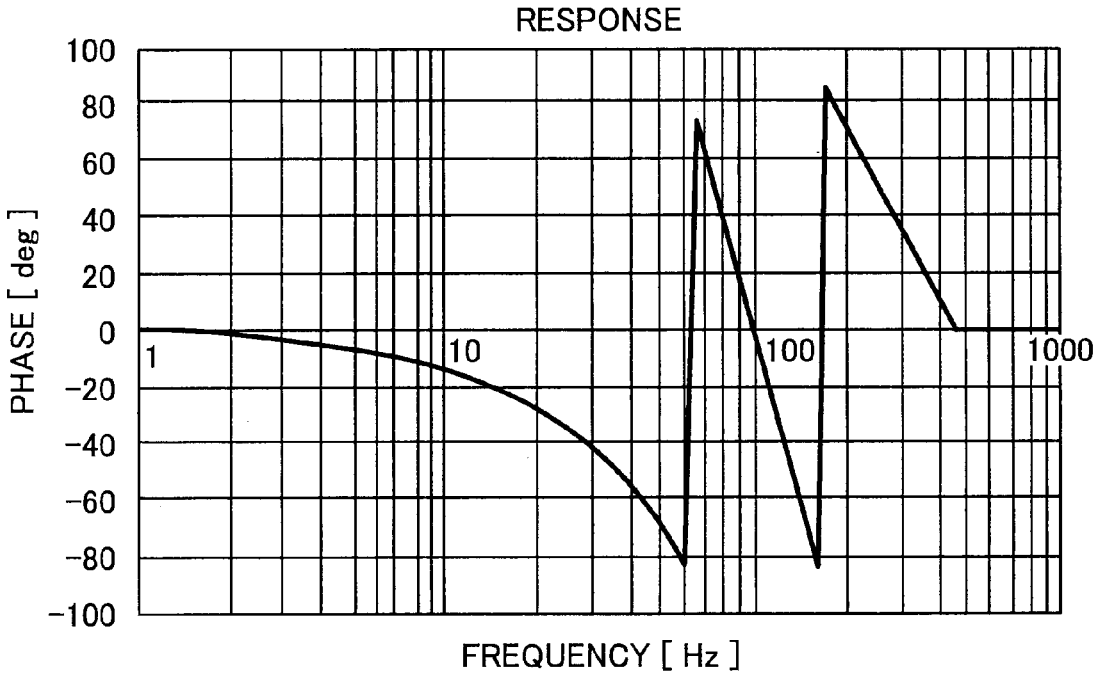
FIG. 13 is a graph of phase characteristics of the filter.

FIG. 12 is a graph of amplitude characteristics of the filter according to this embodiment, and FIG. 13 is a graph of phase characteristics of the filter according to this embodiment.

The controlled variable for the controlled elements is calculated.

In a control block diagram, a proportional integral differential (PID) control is considered to be performed as a position control, the following equation is given.

$$F(S)=G(S)\times E'(S)=Kp\times E'(S)+Ki\times E'(S)/S+Kd\times S\times E'(S)$$

In the equation, Kp denotes a proportional gain, Ki denotes an integral gain, and Kd denotes a derivative gain. Therefore, the following equation (1) is deduced.

$$G(S)=F(S)/E'(S)=Kp+Ki/S+Kd\times S \quad (1)$$

If the equation (1) is subjected to a bilinear conversion ($S=(2/T)\times(1-Z^{-1})/(1+Z^{-1})$), the following equation (2) is obtained.

$$G(Z)=(b0+b1\times Z^{-1}+b2\times Z^{-2})/(1-a1\times Z^{-1}-a2\times Z^{-2}) \quad (2)$$

In the equation (2), a1=0, a2=1, b0=Kp+T×Ki/2+2×Kd/T, b1=T×Ki−4×Kd/T, and b2=−Kp+T×Ki/2+2×Kd/T.

Figure 14:
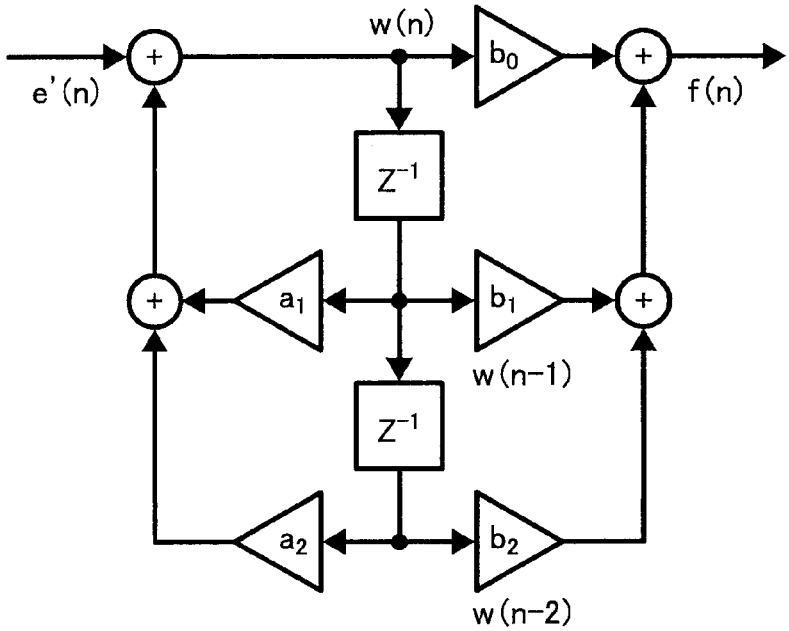
FIG. 14 is a block diagram of a controlled variable with respect to the controlled elements.

If the equation (2) is represented by a block diagram, the block diagram shown in FIG. 14 is obtained. In FIG. 14, e'(n) and f(n) indicate that E'(S) and F(S) are handled as discrete data, respectively. In FIG. 14, if w(n), w(n−1), and w(n−2) are set as intermediate nodes, differential equations (general equations for the PID control) are represented as follows. In FIG. 14, meanings of indexes are as follows.

(n): Present sampling (n−1): Sampling one operation before present sampling (n−2): Sampling two operations before present sampling $$w(n)=a1\times w(n-1)+a2\times w(n-2)+e'(n) \quad (3)$$

$$f(n)=b0\times w(n)+b1\times w(n-1)+b2\times w(n-2) \quad (4)$$

If a proportional control is considered to be performed as the position control, the integral gain and the derivative gain are both zero. Accordingly, respective coefficients shown in FIG. 14 are as follows, and the equations (3) and (4) are simplified as shown in the following equations (5).

$$a1=0$$

$$a2=1$$

$$b0=Kp$$

$$b1=0$$

$$b2=-Kp$$

$$w(n)=w(n-2)+e'(n)$$

$$f(n)=Kp\times w(n)-Kp\times w(n-2)$$

$$\therefore f(n)=Kp\times e'(n) \quad (5)$$

Furthermore, according to this embodiment, the discrete data f0($n$) corresponding to F0(S) is constant and represented as follows.

$$F0(n)=6105\ [\mathrm{Hz}]$$

Accordingly, the pulse frequency set to the transfer drive motor 302 is finally calculated as represented by the following equation (6).

$$f'(n)=f(n)+f0(n)=Kp\times e'(n)+6105\ [\mathrm{Hz}] \quad (6)$$

Figure 15:
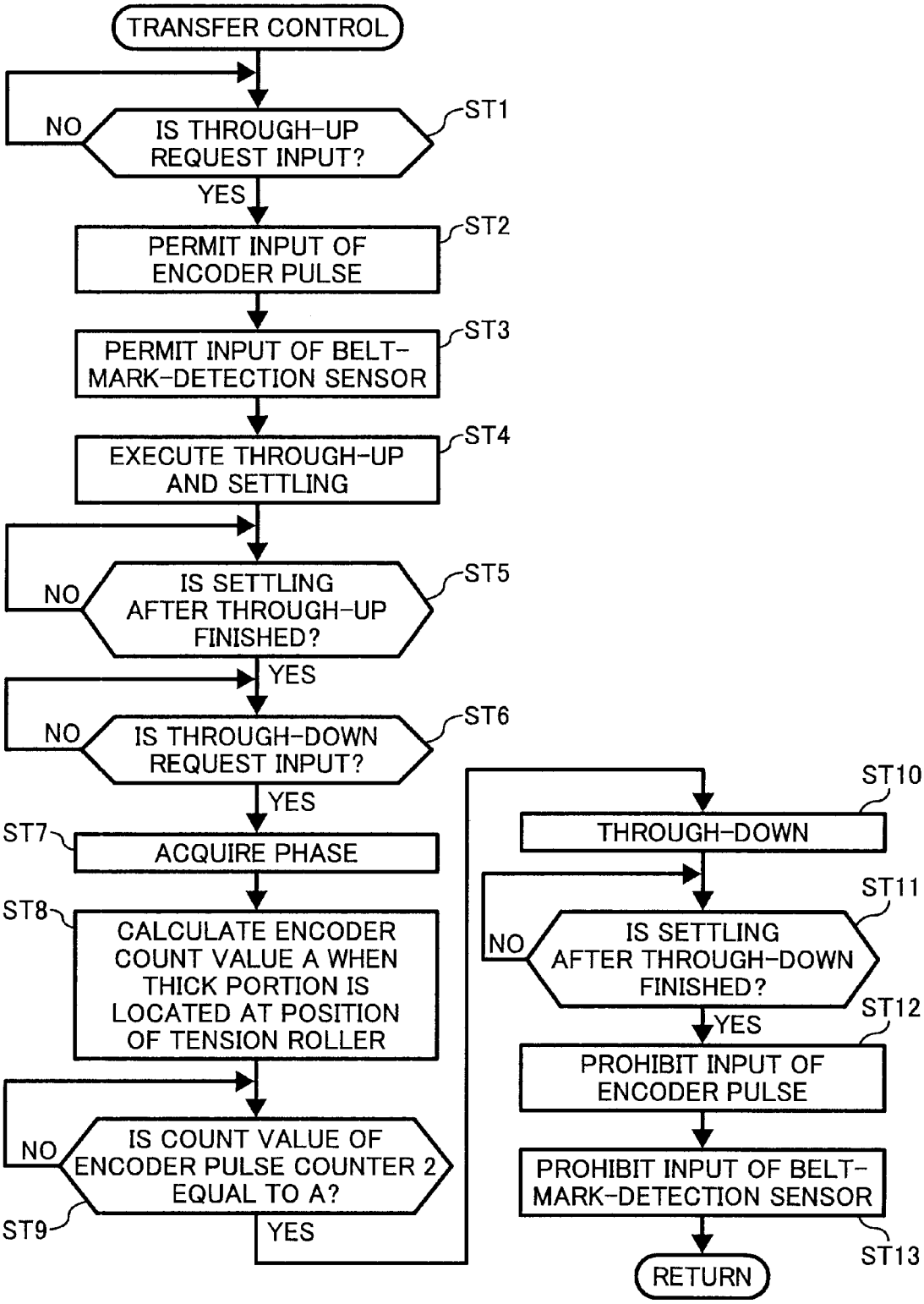
FIG. 15 is an operational flowchart of an encoder pulse counter.

FIG. 15 is an operation flowchart of the transfer and transport belt 60. After a stopped state, the transfer and transport belt 60 continues to be in an idle state until a through-up request is input (at ST(STEP)1). If the through-up request is input, then an input of the encoder pulse is permitted (at ST2), an input of the belt mark sensor 305 is permitted (at ST3), and through-up and settling of the transfer drive motor 302 is executed (at ST4). The moving of the transfer and transport belt 60 is thereby started under the feedback control. Thereafter, while it is monitored whether a through-down request is input (at ST6), the moving of the transfer and transport belt 60 is continued under the feedback control. If the through-down request is input, the phase information is acquired from the EEPROM 611 (at ST7). A count value A of the encoder pulse counter 2 when the thick portion of the transfer and transport belt 60 is located at the position of the tension roller 65 is calculated (at ST8). If the count value of the encoder pulse counter 2 that performs a cumulative operation according to the moving of the transfer and transport belt 60 is equal to the value A (at ST9), the through-down of the transfer drive motor 302 is executed (at ST10). After the end of the through-down (at ST11), the input of the encoder pulse is prohibited (at ST12) and the input of the sensor 305 is prohibited (at ST13). Until a through-up request is input again, the transfer and transport belt 60 continues to be in the idle state. This operation is repeatedly executed.

Figure 16:
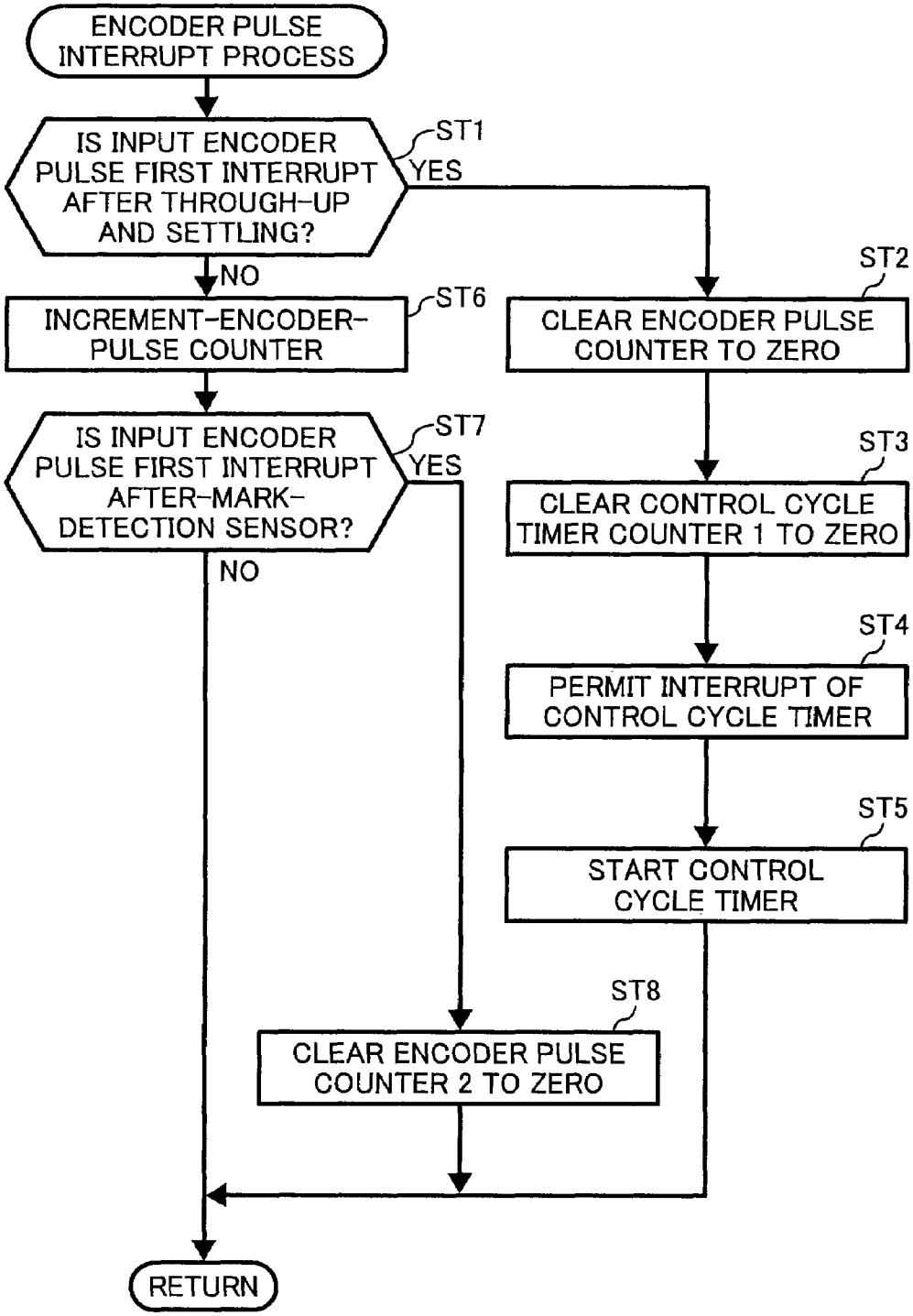
FIG. 16 is another operational flowchart of the encoder pulse counter.

FIG. 16 is an operation flowchart of an encoder pulse input process.

It is determined whether an input encoder pulse is the first pulse after the through-up and settling of the transfer drive motor 302 are executed (at ST1). If YES at the ST1, then the encoder pulse counter 1 is cleared to zero (at ST2), the control cycle counter is cleared to zero (at ST3), and an interrupt of the control cycle timer is permitted (at ST4). In addition, the control cycle timer is started (at ST5), and the process returns to the ST1. If NO at the ST1, then the encoder pulse counter 1 is incremented (at ST6), and it is determined whether the input encoder pulse is the first pulse after the input of the sensor 305 (at ST7). If YES at the ST7, the encoder pulse counter 2 is cleared to zero (at ST8) and the process returns to the ST1.

Figure 17:
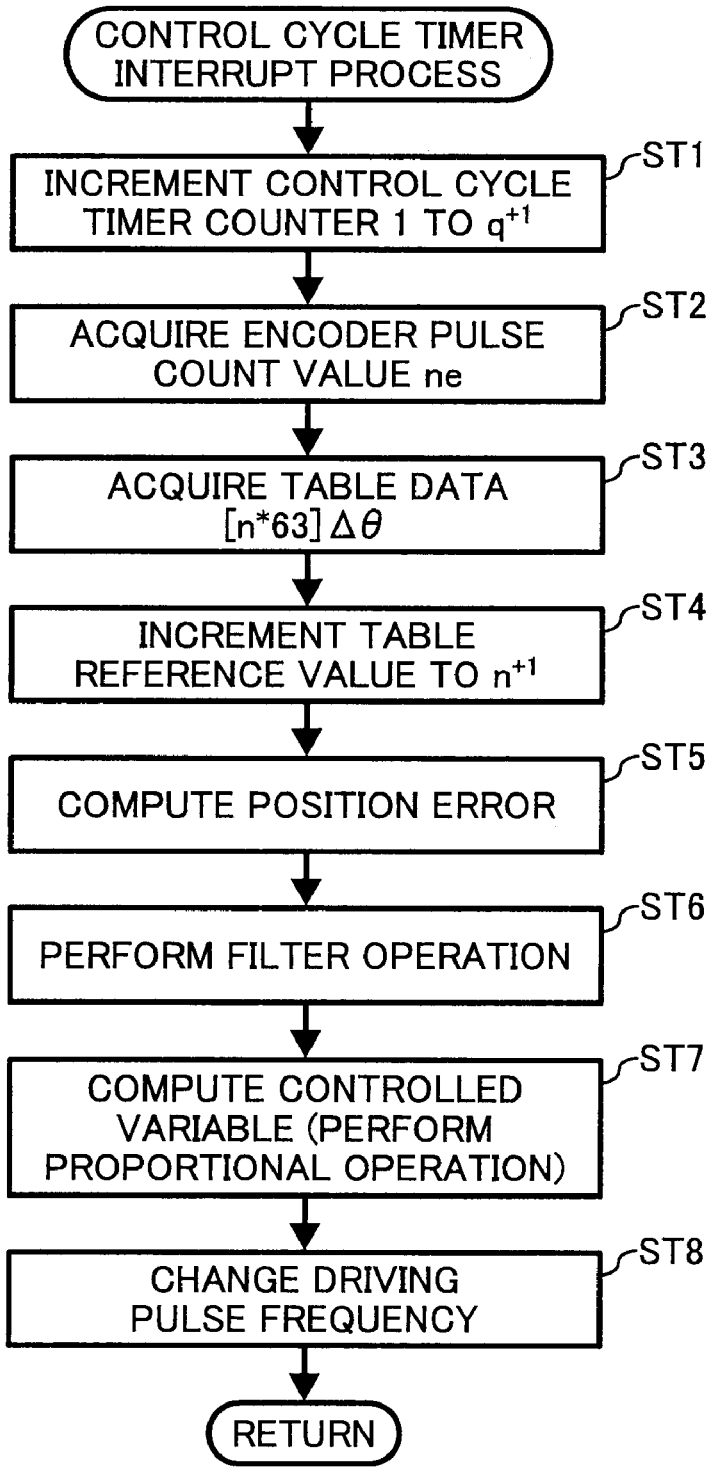
FIG. 17 is a flowchart of a control cycle timer interrupt process.

FIG. 17 is a flowchart of a control cycle timer interrupt process.

The control cycle timer counter is incremented (at ST1), and the count value ne of the encoder pulse counter 1 is acquired (at ST2). Referring to the table data, Δθ is acquired (at ST3), and the table reference address of the RAM 609 is incremented (at ST4). Using these values, the position error e(n) is computed (at ST5). The obtained position error e(n) is subjected to the filter operation (at ST6). Based on a result of the filter operation, the controlled variable is computed (the proportional operation is performed) (at ST7), the driving pulse frequency of the transfer drive motor 302 is actually changed (at ST8), and the process returns to the ST1.

Through these control procedures, the control process for stabilizing the velocity change generated due to change in the belt thickness can be performed appropriately by an inexpensive method according to the image quality.

In the embodiment explained so far, the present invention is applied to the transfer unit 6 of the tandem printer in which the photosensitive drums 11Y, 11M, 11C, and 11K are aligned on the transfer and transport belt 60. However, the printer and the belt drive controlling apparatus to which the invention can be applied are not limited to this configuration. The present invention can be applied to an arbitrary printer including a belt drive controlling apparatus that drives an endless belt spread over a plurality of rollers to be rotated using at least one roller among these rollers, and the belt drive controlling apparatus included in this printer.

According to this embodiment, the invention is applied to the direct transfer image forming apparatus configured so that the transfer sheet 100 is transported by the transfer and transport belt 60, and so that the four color toners from the respective photosensitive drums 11Y, 11M, 11C, and 11K are transferred onto the transfer sheet 100. The present invention is also applicable to the intermediate transfer image forming apparatus configured so that the four color toners are transferred onto the transfer and transport belt 60, the four color toners are registered, and then the resultant full-color toner is transferred onto the transfer sheet 100.

According to this embodiment, the laser light source is used as an exposure light source. However, the exposure light source according to the invention is not limited to the laser light source. For instance, a light emitting diode (LED) array can be used as the exposure light source.

According to the present invention, even if the moving velocity of the endless belt is changed according to the thickness change of the endless belt at the time of controlling the endless belt based on the output of the encoder attached to one of the driven rollers, the endless belt can be feedback controlled appropriately and stably by an inexpensive method according to the image quality.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An endless belt drive controlling apparatus comprising:

an endless belt;

a drive roller that drives the endless belt;

a drive unit that drives the drive roller;

a plurality of driven rollers driven to follow up a movement of the endless belt, wherein an encoder is attached to one of the driven rollers, a desired control value is set so that an angular displacement of the encoder per unit time is constant, and the drive unit is controlled to attain the desired control value; the endless belt drive controlling apparatus further including:

a belt mark indicating a reference position of the endless belt;

a first detector that detects the belt mark;

a second detector that detects a detected angular displacement error of the encoder generated due to a variation in a thickness of the endless belt;

a first calculating unit that calculates a phase and a maximum amplitude of the endless belt at the belt mark based on the detected angular displacement error of the encoder obtained by the second detector;

a nonvolatile memory that stores a calculation result of the first calculating unit; and a second calculating unit that calculates a position of the endless belt at which the detected angular displacement error of the encoder is a minimum from the phase stored in the nonvolatile memory, wherein the drive unit controls the endless belt so that a portion of the endless belt at which the detected angular displacement error of the encoder is the minimum is stopped at a position of one of the driven rollers at which a highest tension is applied to the endless belt when the drive unit issues a belt stop command.

2. The endless belt drive controlling apparatus according to claim 1, wherein the driven roller at the position of which the highest tension is applied to the endless belt is the driven roller that applies a tension to the endless belt.

3. An image forming apparatus that uses an endless belt drive controlling apparatus therein, the endless belt drive controlling apparatus comprising:

an endless belt that transfers and transports a recording member;

a drive roller that drives the endless belt;

a drive unit that drives the drive roller;

a plurality of driven rollers driven to follow up a movement of the endless belt, wherein an encoder is attached to one of the driven rollers, a desired control value is set so that an angular displacement of the encoder per unit time is constant, and the drive unit is controlled to attain the desired control value, thereby to control the speed of the endless belt; the endless belt drive controlling apparatus further including:

a belt mark indicating a reference position of the endless belt;

a first detector that detects the belt mark;

a second detector that detects a detected angular displacement error of the encoder generated due to a variation in a thickness of the endless belt;

a first calculating unit that calculates a phase and a maximum amplitude of the endless belt at the belt mark based on the detected angular displacement error of the encoder obtained by the second detector;

a nonvolatile memory that stores a calculation result of the first calculating unit; and a second calculating unit that calculates a position of the endless belt at which the detected angular displacement error of the encoder is a minimum from the phase stored in the nonvolatile memory, wherein the image forming apparatus makes the drive unit of the endless belt drive controlling apparatus control the endless belt so that a portion of the endless belt at which the detected angular displacement error of the encoder is the minimum is stopped at a position of one of the driven rollers at which a highest tension is applied to the endless belt when the drive unit issues a belt stop command.

4. The image forming apparatus according to claim 3, wherein the driven roller of the endless belt drive controlling apparatus, at the position of which the highest tension is applied to the endless belt, is the driven roller that applies a tension to the endless belt.

5. The image forming apparatus according to claim 3, wherein the image forming apparatus is of a four-drum tandem type.

6. The image forming apparatus according to claim 3, wherein the endless belt of the endless belt drive controlling apparatus is one of an intermediate transfer belt and a direct transfer belt that transfers and transports a recording member.

* * * * *